US008353425B2

(12) United States Patent
Lockwood et al.

(10) Patent No.: US 8,353,425 B2
(45) **Date of Patent: *Jan. 15, 2013**

(54) TIME DELAY PRODUCT PUSHING SYSTEM

(75) Inventors: Thomas A. Lockwood, Clemmons, NC (US); Roger K. Miller, East Bend, NC (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 304 days.

This patent is subject to a terminal disclaimer.

(21) Appl. No.: 12/792,252

(22) Filed: Jun. 2, 2010

(65) Prior Publication Data

US 2010/0237093 A1 Sep. 23, 2010

Related U.S. Application Data

(63) Continuation-in-part of application No. 12/567,370, filed on Sep. 25, 2009, now Pat. No. 8,190,289, which is a continuation-in-part of application No. 11/409,885, filed on Apr. 24, 2006, now abandoned.

(60) Provisional application No. 61/183,321, filed on Jun. 2, 2009, provisional application No. 60/674,880, filed on Apr. 25, 2005.

(51) Int. Cl.
*B65H 1/08* (2006.01)

(52) U.S. Cl. ..... 221/227; 221/279

(58) Field of Classification Search ..... 221/57, 221/227, 279

See application file for complete search history.

(56) References Cited

U.S. PATENT DOCUMENTS

| | | | |
|---|---|---|---|
| 691,990 | A | 1/1902 | Warren |
| 1,034,318 | A | 7/1912 | Sobretto et al. |
| 1,123,071 | A | 12/1914 | Bell |
| 1,319,084 | A | 10/1919 | Hume |
| 1,533,147 | A | 4/1925 | Svendsgaard |
| 1,592,720 | A | 7/1926 | Butler |
| 1,614,363 | A | 1/1927 | Hicks |
| 1,680,275 | A | 8/1928 | Albaugh |
| 1,755,655 | A | 4/1930 | Langenfeld |
| 1,813,935 | A | 7/1931 | Knee |

(Continued)

FOREIGN PATENT DOCUMENTS

DE 202005010088 10/2005

(Continued)

OTHER PUBLICATIONS

Annex to Form PCT/ISA/206—Communication Relating to the Results of the Partial International Search dated Aug. 20, 2010 in related Application No. PCT/US2010/037026.

(Continued)

*Primary Examiner* — Timothy Waggoner
(74) *Attorney, Agent, or Firm* — Kilpatrick Townsend & Stockton LLP

(57) ABSTRACT

A system for controlled advancement of product. Systems of this invention includes a pushing system having a track, a pusher, and an optional resistance mechanism. The resistance mechanism couples to the track and the pusher, controlling forward movement of the pusher along the track and thereby controlling the speed at which product is advanced for access by the consumer. Certain embodiments of the invention include additional mechanisms to further limit the forward progression of the pusher along the track, such as a stop mechanism or an indexing mechanism.

15 Claims, 38 Drawing Sheets

U.S. PATENT DOCUMENTS

| | | | | |
|---|---|---|---|---|
| 1,841,926 | A | | 1/1932 | Wray |
| 1,913,843 | A | | 6/1933 | Marcuse |
| 2,142,053 | A | | 12/1938 | Hoban |
| 2,163,280 | A | | 6/1939 | Hibshman |
| 2,304,533 | A | | 12/1942 | Bright |
| 2,412,368 | A | | 2/1945 | Tascher |
| 2,824,666 | A | | 2/1958 | Hausladen |
| 2,977,023 | A | | 3/1961 | Meyer |
| 3,161,295 | A | | 12/1964 | Chesley |
| 3,199,724 | A | | 8/1965 | Domenico et al. |
| 3,313,448 | A | | 4/1967 | Suttle et al. |
| 3,351,233 | A | | 11/1967 | Chanoch et al. |
| 3,452,899 | A | | 7/1969 | Libberton |
| 3,578,207 | A | | 5/1971 | Danow |
| 3,583,568 | A | | 6/1971 | Crossien |
| 3,591,048 | A | | 7/1971 | Myers et al. |
| 3,749,279 | A | | 7/1973 | Ungerman |
| 3,752,357 | A | | 8/1973 | Harris |
| 3,776,418 | A | | 12/1973 | Bookout |
| 3,777,931 | A | * | 12/1973 | Fleming ..... 221/57 |
| 3,796,345 | A | | 3/1974 | Fessler |
| 3,805,962 | A | | 4/1974 | Bendiksen |
| 3,885,706 | A | * | 5/1975 | Lodge ..... 221/279 |
| 3,923,159 | A | | 12/1975 | Taylor et al. |
| 3,957,173 | A | | 5/1976 | Roudebush |
| 3,968,900 | A | | 7/1976 | Stambuk |
| 3,999,662 | A | | 12/1976 | Barnhardt |
| 4,007,853 | A | | 2/1977 | Bahneman |
| 4,010,869 | A | | 3/1977 | Adamo |
| 4,018,100 | A | | 4/1977 | Moe |
| 4,190,179 | A | | 2/1980 | Moss et al. |
| 4,228,903 | A | | 10/1980 | Eckert |
| 4,275,819 | A | | 6/1981 | Perez |
| 4,308,974 | A | | 1/1982 | Jones |
| 4,336,892 | A | | 6/1982 | Cox et al. |
| 4,369,887 | A | | 1/1983 | Emery |
| 4,371,093 | A | | 2/1983 | Berger |
| 4,412,607 | A | | 11/1983 | Collins et al. |
| 4,474,300 | A | | 10/1984 | Entis |
| 4,506,607 | A | | 3/1985 | Jacoby |
| 4,576,272 | A | | 3/1986 | Morgan et al. |
| 4,679,684 | A | | 7/1987 | Glaser |
| 4,682,826 | A | | 7/1987 | Mestdagh |
| 4,779,760 | A | | 10/1988 | Wittern et al. |
| 4,852,767 | A | | 8/1989 | Humphrey |
| 4,887,737 | A | | 12/1989 | Adenau |
| 4,954,760 | A | | 9/1990 | Futch et al. |
| 4,962,867 | A | | 10/1990 | Ficken et al. |
| 4,965,551 | A | | 10/1990 | Box |
| 5,012,936 | A | | 5/1991 | Crum |
| 5,046,641 | A | | 9/1991 | Gray |
| 5,067,634 | A | | 11/1991 | Vidondo |
| 5,096,367 | A | | 3/1992 | Winski |
| 5,097,611 | A | | 3/1992 | Smollar et al. |
| 5,111,942 | A | | 5/1992 | Bernardin |
| 5,121,854 | A | | 6/1992 | Trouteaud et al. |
| 5,150,101 | A | | 9/1992 | Goris et al. |
| 5,169,027 | A | | 12/1992 | Falk et al. |
| 5,199,598 | A | | 4/1993 | Sampson |
| 5,229,749 | A | | 7/1993 | Yenglin |
| 5,232,102 | A | | 8/1993 | Ozawa |
| 5,240,126 | A | | 8/1993 | Foster et al. |
| 5,248,060 | A | | 9/1993 | Friedman et al. |
| 5,249,705 | A | | 10/1993 | Gates |
| 5,252,948 | A | | 10/1993 | Goris et al. |
| 5,253,782 | A | | 10/1993 | Gates et al. |
| 5,263,596 | A | | 11/1993 | Williams |
| 5,269,597 | A | | 12/1993 | Yenglin et al. |
| 5,285,926 | A | | 2/1994 | Falk et al. |
| 5,335,816 | A | | 8/1994 | Kaufman et al. |
| 5,335,818 | A | | 8/1994 | Maldanis |
| 5,360,134 | A | | 11/1994 | Falk |
| 5,375,735 | A | | 12/1994 | Huvey et al. |
| 5,375,737 | A | | 12/1994 | Ficken |
| 5,385,266 | A | | 1/1995 | Pate |
| 5,397,025 | A | | 3/1995 | Lee |
| 5,400,919 | A | | 3/1995 | Gomm et al. |
| 5,439,136 | A | | 8/1995 | Chatani et al. |
| 5,450,969 | A | | 9/1995 | Johnson et al. |
| 5,460,294 | A | | 10/1995 | Williams |
| 5,462,198 | A | | 10/1995 | Schwimmer |
| 5,542,552 | A | | 8/1996 | Yablans et al. |
| 5,632,408 | A | | 5/1997 | Mitchell |
| 5,665,304 | A | | 9/1997 | Heinen et al. |
| 5,709,315 | A | | 1/1998 | Kahler et al. |
| 5,716,114 | A | * | 2/1998 | Holmes et al. ..... 312/215 |
| 5,790,409 | A | | 8/1998 | Fedor et al. |
| 5,813,568 | A | | 9/1998 | Lowing |
| 5,855,281 | A | | 1/1999 | Rabas |
| 5,909,932 | A | | 6/1999 | Shih |
| 5,927,540 | A | * | 7/1999 | Godlewski ..... 221/2 |
| 5,960,984 | A | | 10/1999 | Weston |
| 5,960,988 | A | | 10/1999 | Freixas |
| 6,084,511 | A | | 7/2000 | Kil |
| 6,131,748 | A | | 10/2000 | Kawasaki et al. |
| 6,176,558 | B1 | | 1/2001 | Hilade et al. |
| 6,189,727 | B1 | * | 2/2001 | Shoenfeld ..... 221/2 |
| 6,196,416 | B1 | | 3/2001 | Seagle |
| 6,199,720 | B1 | | 3/2001 | Rudick et al. |
| 6,206,237 | B1 | | 3/2001 | Dillon et al. |
| 6,230,932 | B1 | | 5/2001 | Lowing et al. |
| 6,241,121 | B1 | | 6/2001 | Yasaka |
| 6,263,259 | B1 | | 7/2001 | Bartur |
| 6,301,501 | B1 | | 10/2001 | Cronin et al. |
| 6,318,591 | B1 | | 11/2001 | Martin |
| 6,325,242 | B1 | | 12/2001 | Izawa et al. |
| 6,454,107 | B1 | | 9/2002 | Belanger et al. |
| 6,464,089 | B1 | | 10/2002 | Rankin |
| 6,474,478 | B1 | | 11/2002 | Huehner et al. |
| 6,478,187 | B2 | | 11/2002 | Simson et al. |
| 6,520,604 | B1 | | 2/2003 | Yasaka et al. |
| 6,581,798 | B2 | | 6/2003 | Liff et al. |
| 6,601,416 | B1 | | 8/2003 | Sanders |
| 6,604,652 | B1 | | 8/2003 | Trautwein |
| 6,622,979 | B2 | | 9/2003 | Valiulis |
| 6,659,291 | B2 | | 12/2003 | Huehner et al. |
| 6,684,126 | B2 | | 1/2004 | Omura et al. |
| 6,691,891 | B2 | | 2/2004 | Maldonado |
| 6,694,221 | B2 | | 2/2004 | Chavez et al. |
| 6,735,473 | B2 | | 5/2004 | Kolder et al. |
| D491,403 | S | | 6/2004 | Gervasi |
| 6,758,370 | B2 | | 7/2004 | Cooke et al. |
| 6,776,304 | B2 | | 8/2004 | Liff et al. |
| 6,786,341 | B2 | | 9/2004 | Stinnett et al. |
| 6,814,254 | B2 | | 11/2004 | Liff et al. |
| 6,814,255 | B2 | | 11/2004 | Liff et al. |
| 6,857,539 | B2 | | 2/2005 | Parra |
| 6,892,898 | B1 | | 5/2005 | Boone et al. |
| 6,957,555 | B1 | | 10/2005 | Nagel et al. |
| 7,007,810 | B2 | | 3/2006 | Huehner et al. |
| 7,017,778 | B2 | | 3/2006 | Halbherr |
| 7,024,894 | B2 | | 4/2006 | Salonen |
| 7,032,776 | B2 | | 4/2006 | Hieb |
| D521,363 | S | | 5/2006 | Copen et al. |
| 7,052,097 | B2 | * | 5/2006 | Meek et al. ..... 312/222 |
| 7,086,541 | B2 | | 8/2006 | Robertson |
| 7,128,221 | B2 | | 10/2006 | Metcalf |
| 7,128,239 | B2 | | 10/2006 | Skavnak |
| 7,149,600 | B2 | | 12/2006 | Rippolone |
| 7,150,365 | B2 | | 12/2006 | Hardy et al. |
| 7,151,982 | B2 | | 12/2006 | Liff et al. |
| 7,178,678 | B2 | | 2/2007 | Mansfield et al. |
| 7,197,902 | B1 | | 4/2007 | Barkdoll |
| 7,207,447 | B2 | | 4/2007 | Medcalf et al. |
| 7,213,722 | B2 | | 5/2007 | Nagelski et al. |
| 7,246,711 | B1 | | 7/2007 | Metcalf |
| 7,249,761 | B2 | | 7/2007 | Graef et al. |
| 7,264,138 | B2 | | 9/2007 | Collins et al. |
| 7,269,983 | B1 | | 9/2007 | Mchatet et al. |
| 7,293,672 | B2 | | 11/2007 | Mori |
| 7,299,934 | B2 | | 11/2007 | Hardy et al. |
| 7,303,095 | B2 | | 12/2007 | Nagelski et al. |
| 7,347,335 | B2 | | 3/2008 | Rankin, VI et al. |
| 7,348,884 | B2 | | 3/2008 | Higham |
| 7,389,886 | B2 | | 6/2008 | Hardy et al. |
| 7,451,881 | B2 | | 11/2008 | Hardy et al. |
| 7,458,473 | B1 | | 12/2008 | Mason |

| | | | | |
|---|---|---|---|---|
| 7,469,791 | B2 | 12/2008 | Phoy | |
| 7,497,341 | B2 | 3/2009 | Hardy et al. | |
| 7,533,784 | B2 | 5/2009 | Vlastakis et al. | |
| 7,564,351 | B2 | 7/2009 | Nagelski et al. | |
| 7,621,409 | B2 | 11/2009 | Hardy et al. | |
| 7,641,072 | B1 | 1/2010 | Vlastakis et al. | |
| 7,661,545 | B2 | 2/2010 | Hardy et al. | |
| 7,669,722 | B2 | 3/2010 | Hardy et al. | |
| 7,675,421 | B2 | 3/2010 | Higham | |
| 7,768,399 | B2 | 8/2010 | Hachmann et al. | |
| 7,823,734 | B2 | 11/2010 | Hardy | |
| 7,828,158 | B2 | 11/2010 | Colelli et al. | |
| 8,013,740 | B2 | 9/2011 | Irmscher et al. | |
| 8,038,016 | B2 * | 10/2011 | Yuyama et al. | 211/59.3 |
| 8,047,385 | B2 | 11/2011 | Hardy | |
| 8,056,734 | B2 | 11/2011 | Menz et al. | |
| 8,056,740 | B2 | 11/2011 | Weshler et al. | |
| 8,090,473 | B2 * | 1/2012 | Higham | 700/242 |
| 8,146,753 | B2 * | 4/2012 | Yuyama | 211/59.3 |
| 8,190,289 | B2 | 5/2012 | Lockwood | |
| 2003/0029816 | A1 | 2/2003 | Huchner et al. | |
| 2003/0121929 | A1 | 7/2003 | Liff et al. | |
| 2003/0178435 | A1 | 9/2003 | Yamaguchi | |
| 2003/0189058 | A1 | 10/2003 | Liff et al. | |
| 2004/0026344 | A1 | 2/2004 | Sedon et al. | |
| 2004/0059464 | A1 | 3/2004 | Veenstra et al. | |
| 2004/0060944 | A1 | 4/2004 | Gervasi | |
| 2004/0084386 | A1 | 5/2004 | Huehner et al. | |
| 2004/0104239 | A1 | 6/2004 | Black et al. | |
| 2004/0149768 | A1 | 8/2004 | Scoville et al. | |
| 2004/0238557 | A1 | 12/2004 | Chirnomas | |
| 2005/0029205 | A1 | 2/2005 | Mansfield et al. | |
| 2005/0029283 | A1 | 2/2005 | Pedigo | |
| 2005/0065645 | A1 | 3/2005 | Liff et al. | |
| 2005/0189369 | A1 | 9/2005 | Vlastakis | |
| 2005/0189370 | A1 | 9/2005 | Carter et al. | |
| 2005/0199644 | A1 | 9/2005 | Barili et al. | |
| 2005/0205596 | A1 | 9/2005 | Kelly | |
| 2005/0252925 | A1 | 11/2005 | Kelly | |
| 2006/0138915 | A1 | 6/2006 | Goldberg | |
| 2006/0157431 | A1 | 7/2006 | Nagelski et al. | |
| 2006/0163272 | A1 * | 7/2006 | Gamble | 221/227 |
| 2006/0219730 | A1 | 10/2006 | Handfield et al. | |
| 2006/0237381 | A1 | 10/2006 | Lockwood et al. | |
| 2006/0266762 | A1 | 11/2006 | Andrews et al. | |
| 2007/0029340 | A1 | 2/2007 | Nagelski et al. | |
| 2007/0078561 | A1 | 4/2007 | Sansone | |
| 2007/0080175 | A1 | 4/2007 | Petersen | |
| 2007/0119796 | A1 | 5/2007 | Barkdoll | |
| 2007/0199863 | A1 | 8/2007 | Knoettgen-Nap | |
| 2007/0221679 | A1 | 9/2007 | Chandler et al. | |
| 2007/0251900 | A1 | 11/2007 | Hardy | |
| 2007/0273513 | A1 | 11/2007 | White | |
| 2007/0278164 | A1 | 12/2007 | Lang et al. | |
| 2007/0283615 | A1 | 12/2007 | Vlastakis | |
| 2008/0092394 | A1 | 4/2008 | Freitag et al. | |
| 2008/0142538 | A1 | 6/2008 | Miller | |
| 2008/0246375 | A1 | 10/2008 | Berq | |
| 2008/0283477 | A1 | 11/2008 | Wamsley et al. | |
| 2009/0084745 | A1 | 4/2009 | Goehring | |
| 2009/0166304 | A1 | 7/2009 | Hardy et al. | |
| 2009/0184069 | A1 | 7/2009 | Hardy | |
| 2009/0184129 | A1 | 7/2009 | Vlastakis et al. | |
| 2009/0184130 | A1 | 7/2009 | Miller et al. | |
| 2009/0242582 | A1 | 10/2009 | Vlastakis et al. | |
| 2009/0321373 | A1 | 12/2009 | Hardy | |
| 2010/0017025 | A1 | 1/2010 | Lockwood | |
| 2010/0079240 | A1 | 4/2010 | Higham | |
| 2010/0147783 | A1 | 6/2010 | Hardy | |
| 2010/0188221 | A1 | 7/2010 | Irmscher et al. | |
| 2011/0017763 | A1 | 1/2011 | Colelli et al. | |
| 2011/0042331 | A1 | 2/2011 | Johnson et al. | |
| 2011/0042332 | A1 | 2/2011 | Hardy | |
| 2011/0094975 | A1 | 4/2011 | Hardy | |
| 2011/0210084 | A1 | 9/2011 | Hardy | |
| 2011/0220597 | A1 | 9/2011 | Sherretts et al. | |
| 2011/0240569 | A1 | 10/2011 | Kahl et al. | |
| 2011/0284488 | A1 | 11/2011 | Hardy | |
| 2011/0315706 | A1 | 12/2011 | Lockwood | |
| 2012/0000869 | A1 | 1/2012 | Hardy | |

FOREIGN PATENT DOCUMENTS

| | | |
|---|---|---|
| DE | 202005019621 | 3/2006 |
| DE | 202007011927 | 12/2007 |
| EP | 1541064 | 6/2005 |
| EP | 1579789 | 9/2005 |
| JP | 1144185 | 6/1989 |
| JP | 2219194 | 8/1990 |
| JP | 9319937 | 12/1997 |
| JP | 2005049965 | 1/2005 |
| JP | 2006285930 | 10/2006 |
| WO | WO-8912873 | 12/1989 |
| WO | WO-2004028311 | 4/2004 |
| WO | WO-2007054042 | 5/2007 |
| WO | WO-2007085211 | 8/2007 |
| WO | WO2010094778 | 8/2010 |
| WO | WO-2010141552 A2 | 12/2010 |

OTHER PUBLICATIONS

International Preliminary Report on Patentability dated Dec. 15, 2011 in Application No. PCT/US2010/037026.

International Search Report and Written Opinion in International Application Serial No. PCT/US2010/037026 mailed Nov. 26, 2010.

* cited by examiner

TIME DELAY PRODUCT PUSHING SYSTEM

RELATED APPLICATION DATA

The present application claims priority to U.S. Provisional Application No. 61/183,321, filed Jun. 2, 2009, entitled "TIME DELAY PRODUCT PUSHING SYSTEM," the contents of which are herein incorporated by reference. The present application is also a continuation-in-part of U.S. Ser. No. 12/567,370, filed Sep. 25, 2009, entitled "TIME DELAY PRODUCT PUSHING SYSTEM," which is a continuation-in-part of Ser. No. 11/409,885, filed Apr. 24, 2006, entitled "TIME DELAY PRODUCT PUSHING SYSTEM," which claims priority to U.S. Provisional Application No. 60/674,880, filed Apr. 25, 2005, the contents of all of which are hereby incorporated by reference.

FIELD OF THE INVENTION

Embodiments of this invention generally relate to systems for advancing product on a shelf and, in particular, devices that allow for controlled forward movement of product.

BACKGROUND

Theft of small items in retail stores is an all too common problem. Items that are in high demand by thieves include over-the-counter (OTC) products such as analgesics and cough and cold medications, razor blades, camera film, batteries, videos, DVDs, smoking cessation products and infant formula. Shelf sweeping is a particular problem for small items. Shelf sweeping occurs when individuals or groups remove all the shelf stock and exit the store, similar to a "smash and grab" shoplifting technique. Shelf sweeping relies on excessive quantities of product being available on the shelf. Retailers must keep substantial inventory on shelf or incur the cost, including labor costs, of constantly restocking.

In addition to preventing theft, retail stores may want to limit the purchase of certain items. For example, to make methamphetamine, large quantities of cold medication are needed. Pseudoephedrine, the sole active ingredient in many cold medicines and decongestants, is also a key ingredient in methamphetamine, a powerful and highly addictive stimulant.

Retailers are constantly challenged to balance the needs of legitimate consumers' access to high theft items with measures to minimize the incidence of theft. Because theft has become so rampant in certain product categories, such as razors and infant formula, many retail stores are taking the products off the shelves and placing them behind the counter or under lock and key. Customers must request the products to make a purchase. This requires additional labor costs to provide individual service to customers who would normally not require it. It also makes it difficult for customers to compare products. Furthermore, it might not be feasible where the space behind the counter is limited and is needed for prescription medications. In some cases, products are simply unavailable due to high pilferage rates. Therefore, a device or dispensing apparatus that minimizes the incidence of product theft is needed.

Studies have shown that a desirable form of theft deterrence is to cause a time delay between the dispensing of multiple products. Would be thieves are less likely to steal products if there is a substantial delay between the dispensing of individual products. It is also desirable to achieve time delayed dispensing of products in cost effective manner.

SUMMARY

Systems of this invention provide controlled advancement of product on a shelf unit. As a first product is removed from the shelf unit, the products located behind the one that was removed must move forward. A pushing system of one embodiment of this invention includes a pusher, a track, and a stop mechanism. In some embodiments, the pushing system includes a resistance mechanism that is coupled to the track and the pusher and that controls forward movement of the pusher along the track and thereby controls the speed at which product is advanced for access by the consumer. When engaged, the stop mechanism prevents the pusher from advancing product forward.

A pushing system according to another embodiment of this invention includes a pusher, a track, and an indexing mechanism. In some embodiments, the pushing system includes a resistance mechanism that is coupled to the track and the pusher and that controls forward movement of the pusher along the track and thereby controls the speed at which product is advanced for access by the consumer. When the pushing system is activated, the indexing mechanism limits the forward progression of the pusher by a discrete distance.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different figures is intended to illustrate like or analogous components.

DETAILED DESCRIPTION

Certain embodiments of the invention comprise a pushing system 10, such as a product pushing device, for advancing product. For example, it may be desirable to position product close to the edge of a shelf unit. As a first product is removed from the shelf unit, it may be desirable for the products located behind the one that was removed to move forward. A pushing system may be used to accomplish the forward movement of product.

Figure 1:
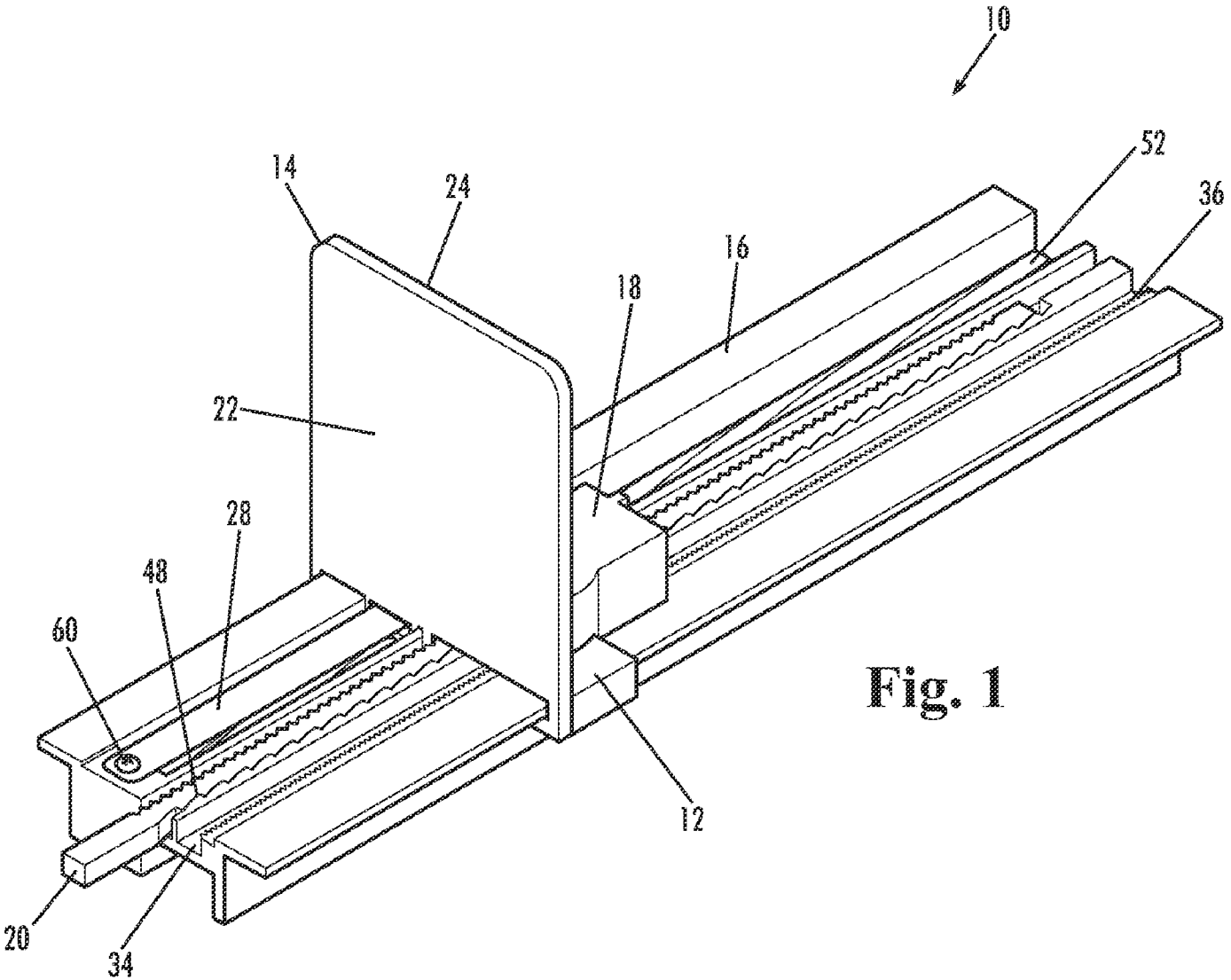
FIG. 1 is a front perspective view of a pushing system according to one embodiment of the invention.

According to one embodiment, pushing system 10, shown in FIGS. 1-10, comprises a pusher 12, a track 16, a resistance mechanism 18, and a stop 20. Pusher 12 includes a pushing ram 14 that engages product (not shown) and pushes product forward. As shown in FIG. 1, pushing ram 14 includes a front surface 22 for engaging product and a rear surface 24. In one embodiment, shown in FIGS. 1-10, the pushing ram 14 is a rectangular plate, although other suitable shapes and geometries may also be used. In some embodiments, pusher 12 includes gusset 26 (shown in FIGS. 5, 6, and 8) for reinforcing pusher 12 and providing a housing for spring 28 (further described below).

Figure 8:
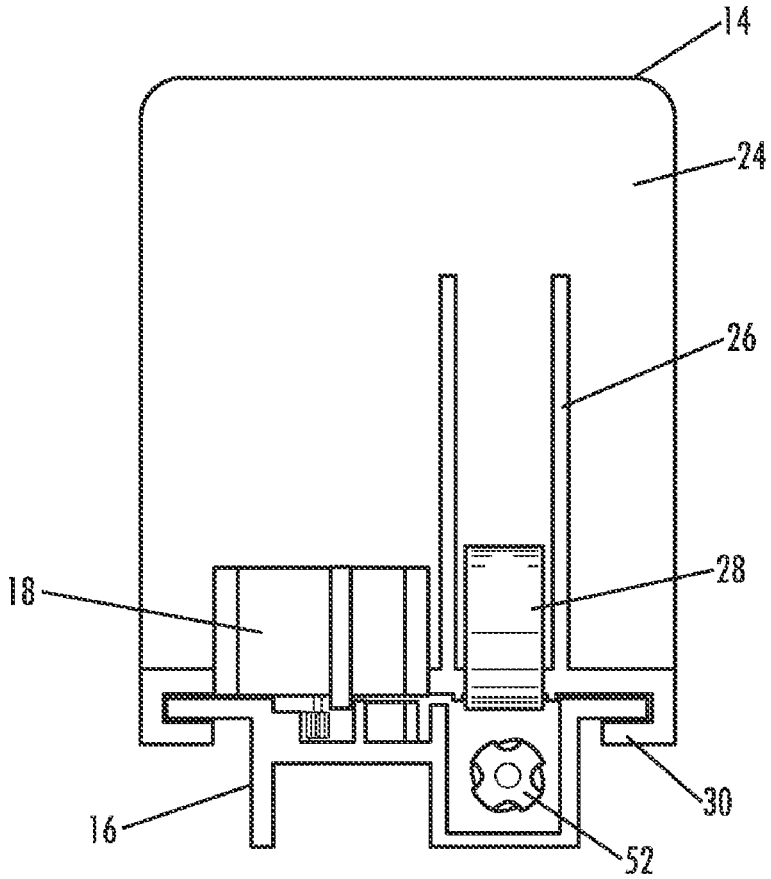
FIG. 8 is a rear plan view of the pushing system of FIG. 1.

As shown in FIG. 8, extension 30 of pusher 12 extends beyond the bottom portion of pushing ram 14. In this manner, extension 30 engages track 16, so that pusher 12 is in sliding engagement with track 16.

Figure 2:
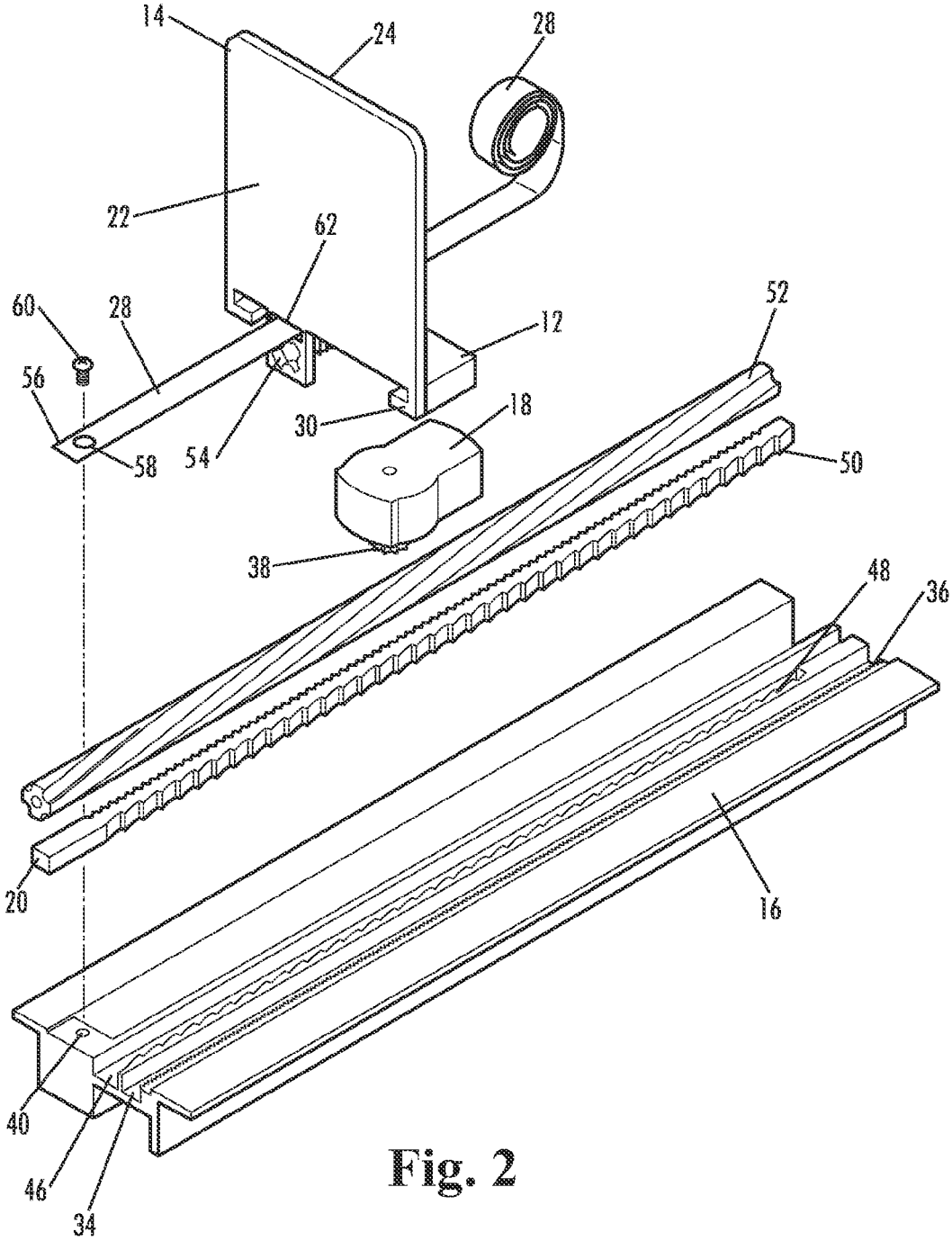
FIG. 2 is a exploded view of the pushing system of FIG. 1.
Figure 3:
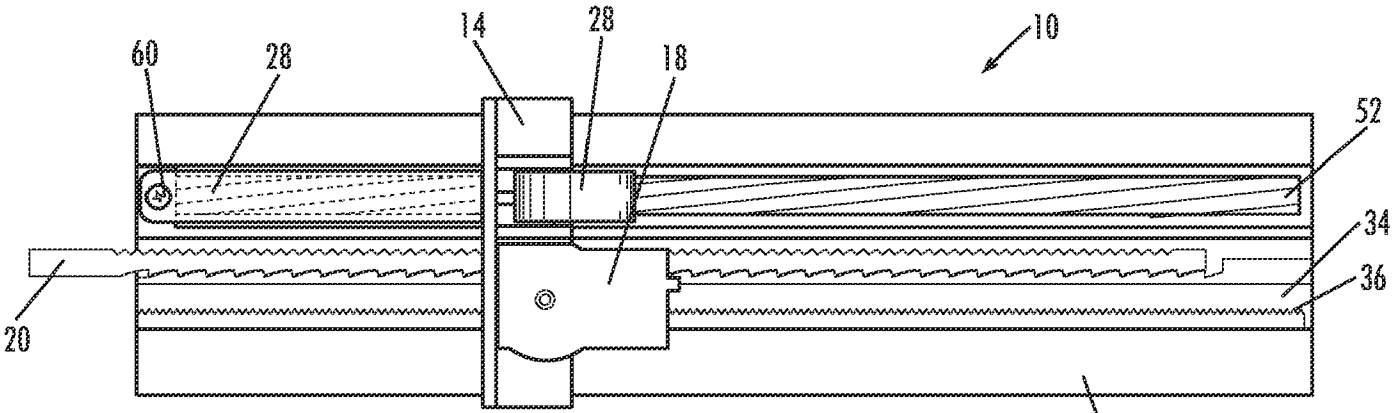
FIG. 3 is a top plan view of the pushing system of FIG. 1.
Figure 4:
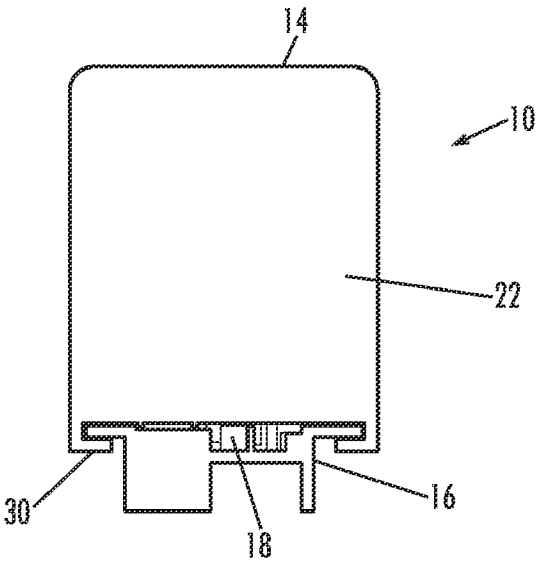
FIG. 4 is a front plan view of the pushing system of FIG. 1.
Figure 5:
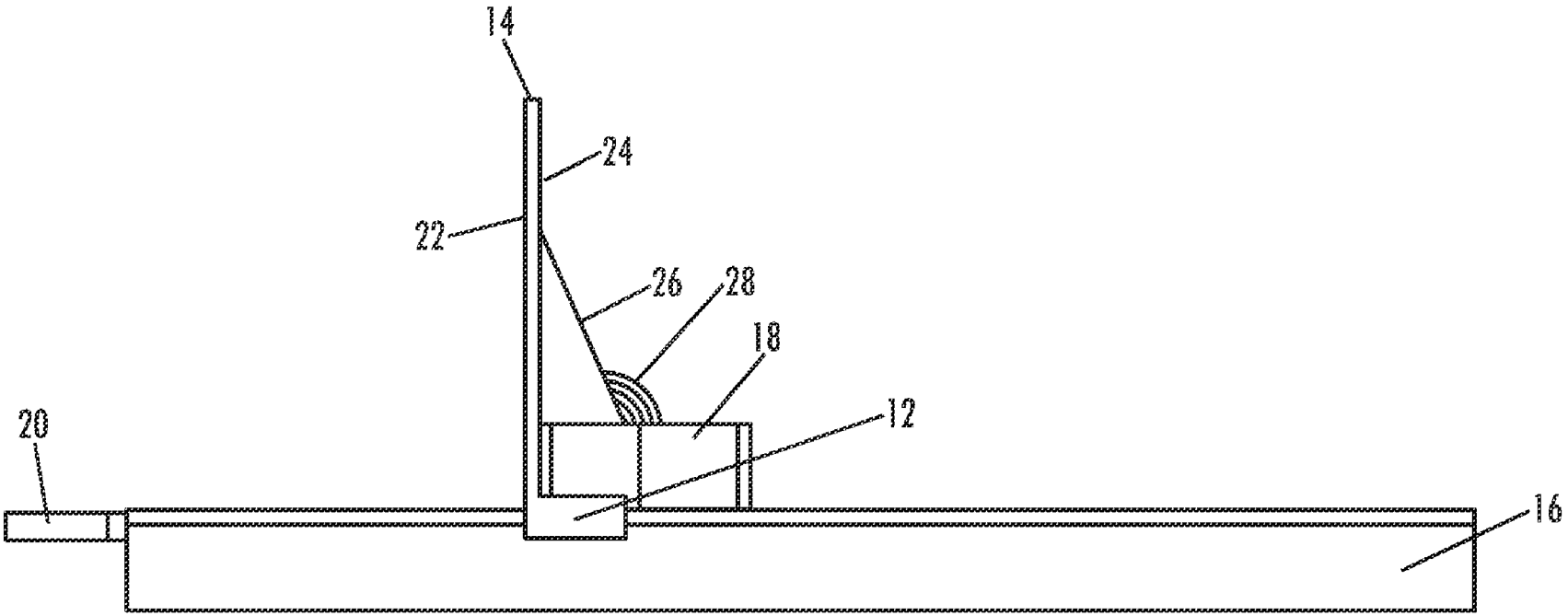
FIG. 5 is a side plan view of the pushing system of FIG. 1.
Figure 6:
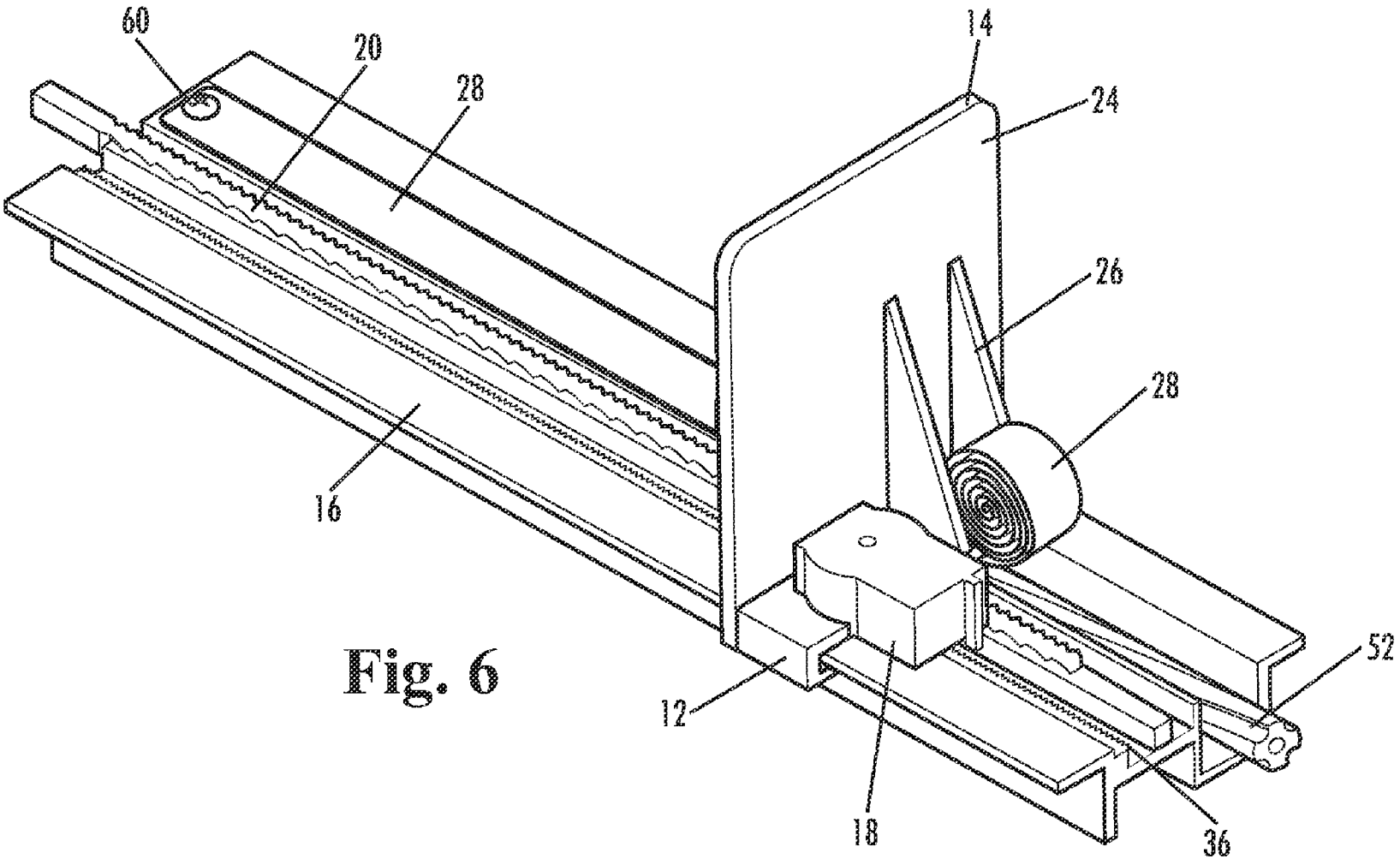
FIG. 6 is a rear perspective view of the pushing system of FIG. 1.
Figure 7:
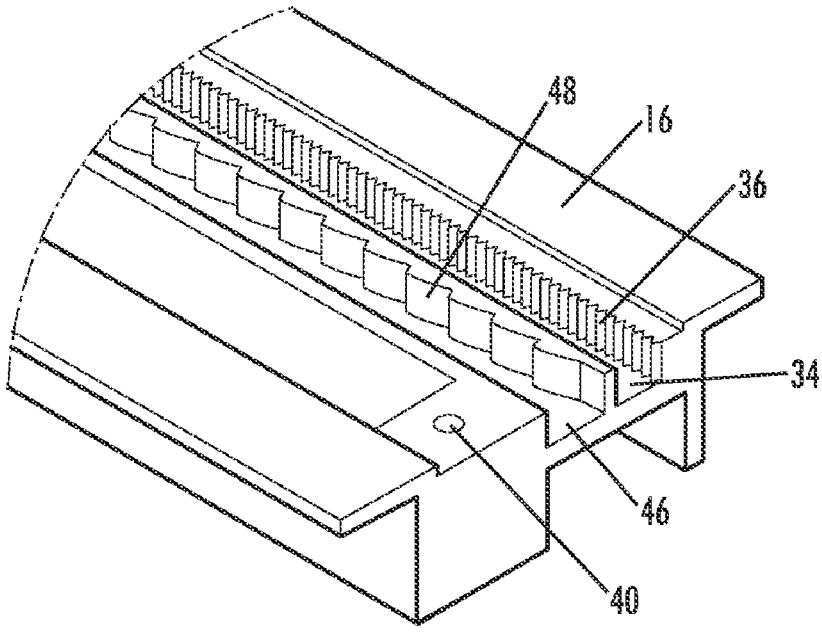
FIG. 7 is an enlarged perspective view of the track of FIG. 1.
Figure 9:
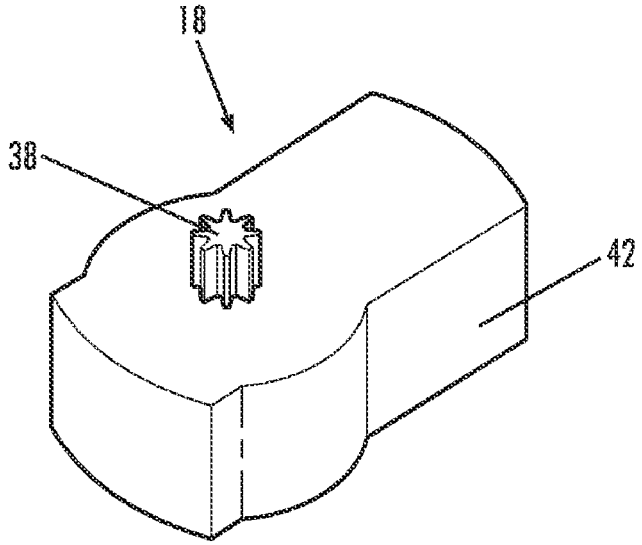
FIG. 9 is a perspective view of the resistance mechanism of FIG. 1.
Figure 10:
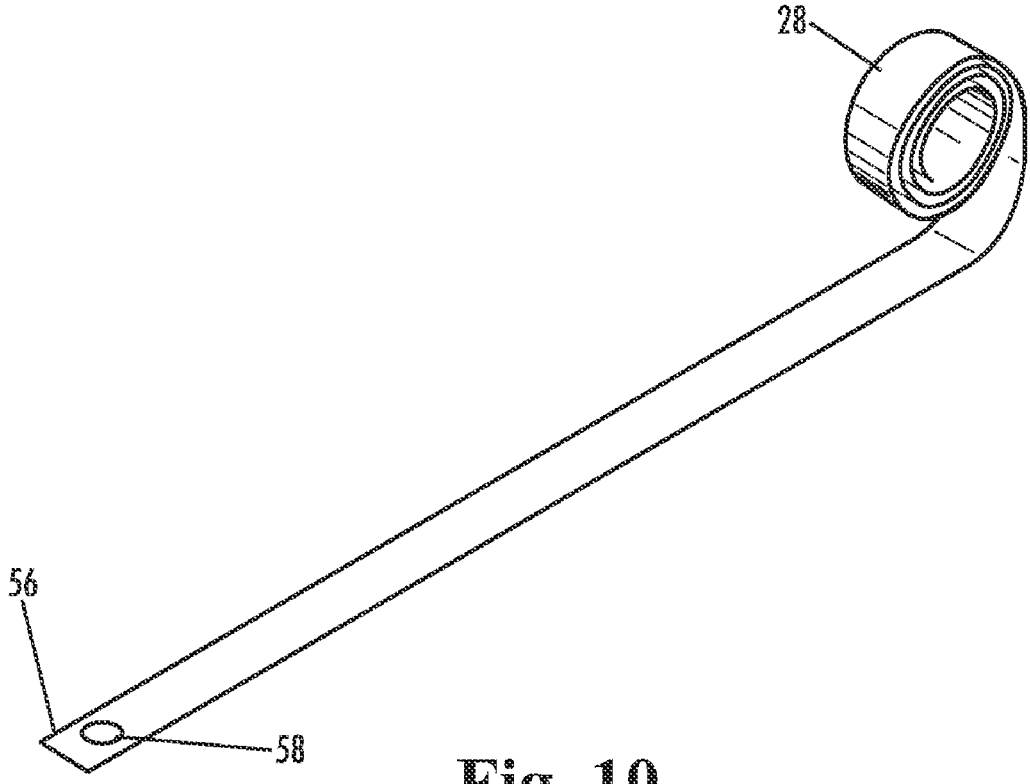
FIG. 10 is a perspective view of the spring of FIG. 1.

As shown in FIGS. 1-3 and 6-7, track 16 includes a resistance channel 34 having exposed gear teeth 36 that project into resistance channel 34 and engage external gear component 38 of the resistance mechanism 18, shown in FIGS. 2 and 9 and further described below. The gear teeth may be positioned in various other manners along the resistance channel 34 and maintain the functionality of the pushing system. Track 16 also includes a stop channel 46 having a plurality of engagement surfaces 48 that project into stop channel 46. Engagement surfaces 48 are positioned along the stop channel 46 to engage one of a plurality of external engagement components 50 of stop mechanism 20 (described below).

As shown in FIG. 2, spring 28 extends through a slot 62 in the pusher 12 and attaches to the opening 40 of the track 16. In the embodiment shown in FIG. 2, end 56 of spring 28 includes aperture 58, through which any suitable fastener, such as a screw 60, may pass to attach spring 28 to opening 40 of track 16. Spring 28 may also be attached to pushing system 10 in any other suitable manner. Movement of pusher 12 toward the back end of the track 16 unwinds spring 28 so that spring 28 urges pusher 12 in the forward direction. The spring preferably may be a constant force spring, such as those sold under the trademark Conforce®, but many other types of springs, such as a variable force spring, may also be used.

In some embodiments, resistance mechanism 18 is attached to pusher 12. As shown in FIG. 9, resistance mechanism 18 includes a housing 42 and an external gear component 38. Resistance mechanism 18 is positioned on pusher 12 so that external gear component 38 extends into resistance channel 34 of track 16 and engages gear teeth 36. According to certain embodiments, one such resistance mechanism is a resistance motor, such as the resistance motor Model #w217 sold by Vigor, although other types of motors may also be used. In other embodiments, resistance mechanism is a rotary damper.

As one product is selected from the front of pushing system 10, the compression of the spring 28 causes the pushing ram 14 to move forward and the external gear component 38 to rotate along gear teeth 36 of track 16. This in turn causes the remaining product to move forward along track 16. Resistance mechanism 18, however, reduces the speed of this forward progression. The internal gears of the resistance mechanism are preferably configured to provide resistance to the forward movement by limiting the rotation of the external gear component 38. Because the external gear component 38 engages gear teeth 36 of track 16 and the external gear rotation is limited, the movement of pushing ram 14 and therefore the remaining product to the front of track 16 is slowed.

Product can be loaded in pushing system 10 by forcing pushing ram 14 backwards along track 16 and placing multiple units of the product against the pushing ram 14. As described above, spring 28 causes the pushing ram 14 to exert force on the products towards the front of the track 16. Resistance mechanism 18 preferably allows pushing ram 14 to be forced backwards freely for loading of the product.

The pushing system shown in FIGS. 1-10 includes a stop mechanism 20 that may be engaged to prevent the pusher 12 from advancing product forward. The stop mechanism 20 includes external engagement components 50 and is coupled in any suitable manner with the pusher 12.

In one embodiment, stop mechanism 20 is positioned within stop channel 46 so that the external engagement components 50 of stop mechanism 20 engage engagement surfaces 48 of the stop channel 46. When sufficient force is applied to the stop mechanism 20 so that the stop mechanism 20 moves in a generally horizontal direction toward the rear of the track 16, the external engagement components 50 of stop mechanism 20 abut the engagement surfaces 48 of the stop channel to prevent forward movement of the pusher 12. The external engagement components 50 form a generally sawtooth shape in cross section and are configured to stop the forward movement of the pusher 12. The stop channel 46 further includes an inclined surface that engages the stop mechanism 20 as it is pushed so that the stop mechanism 20 moves both horizontally toward the rear of the track 16 and upward at the same time. When stop mechanism 20 is not engaged (no force is applied to stop mechanism 20), the external engagement components 50 of stop mechanism 20 may contact the engagement surfaces 48 of the stop channel 46 as the pusher 12 moves forward, but the external engagement components 50 do not prevent forward movement of the pusher 12.

In some embodiments, stop mechanism 20 may be spring-loaded so that the stop mechanism 20 returns to its non-engaged position so that the pusher 12 is allowed to move in a forward direction.

In some embodiments, the pushing system 10 may be housed in a display device that includes an access door, or other suitable structure, that blocks access to the product when the access door is in the closed position. The access door may be configured to cooperate with stop mechanism 20, so that when the access door is open, the door applies sufficient force to engage the stop mechanism 20 to stop forward movement of the pusher 12, as described above. As a result, only the forward-most product is able to be vended when the access door is open. When the access door is closed, the access door does not engage stop mechanism 20 and the pusher 12 is free to move forward due to the action of the spring 28 and as slowed by the resistance mechanism 18, as described above. In this way, the pushing system 10 is preferably configured so that only one product may be removed at a time. The pushing system 10 is also preferably configured so that product may only be removed when at the front of the track 16. This requires someone who wants to remove more than one product from the pushing system to wait for several seconds between removal of each product, which has been found to be a substantial deterrence to product theft.

Alternatively, a spring-loaded push button could enact the device so that a product might be advanced to an incline delivery chute instead of a door.

In certain embodiments, as shown in FIGS. 1-3 and 6, pushing system 10 includes a shaft 52 that extends through an opening 54 in the pusher 12. The shaft 52 may engage a rotary potentiometer, or other suitable device, for inventory control, as described in U.S. Ser. No. 12/567,370, the contents of which are herein incorporated by reference. The shaft 52 may be helix shaped and is held at either end of the track so that the shaft 52 can rotate without being impeded. In these embodiments, the pusher 12 has an opening 54 cut in a corresponding shape (i.e., helix geometry plus a small amount of tolerance) so that when the pusher 12 moves in a forward or backward direction, the linear motion is translated into a rotary motion of the shaft 52. The shaft 52 may then be connected to an electronic assembly containing a rotary potentiometer. The pitch of the shaft 52 is such that the revolution of the shaft 52 is slightly less than 360°, as determined by the most forward and rear position of the pusher 12 on the track. Known voltage values can then be translated into counts of the products on the track, which stores information about when product is added or removed from the track.

In some embodiments, the access door is made of a translucent material so that the products stored within the display case are visible. According to certain embodiments, the pusher and track may all be made from molded plastic, although numerous other materials may be used if desired. The gear teeth may preferably be molded into the track in the desired orientation.

According to certain embodiments, the pushing system may be used with product hanging hooks (not shown). Product hanging hooks may be configured to slide along the track. As a first product is selected, a spring may cause the subsequent product to move forward along the track. Resistance mechanisms may be used with each hook to slow the progression of the subsequent product by limiting the rotation of the external gear component along the gear teeth of the rack gear.

Figure 11:
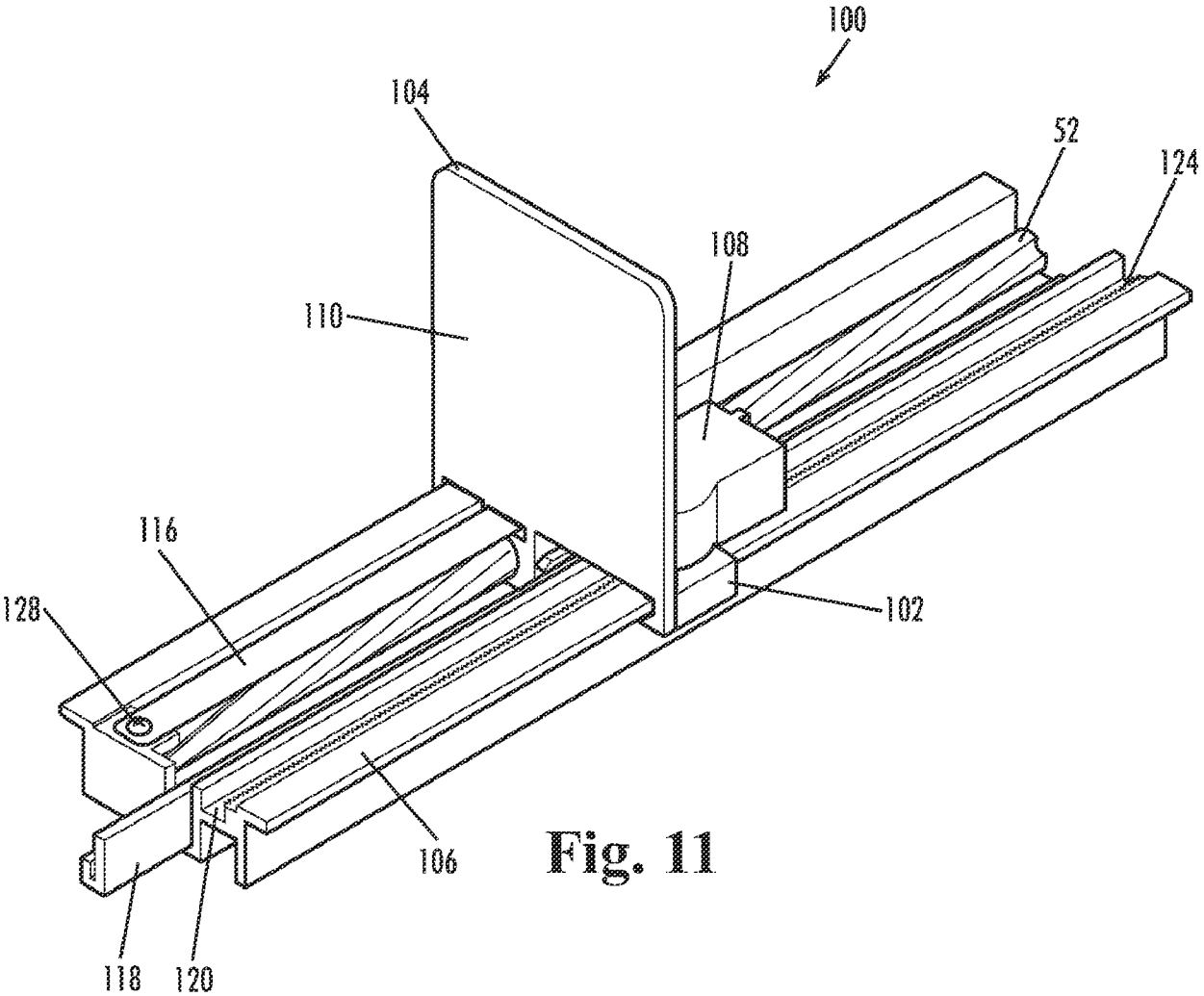
FIG. 11 is a front perspective view of a pushing system according to another embodiment of the invention.
Figure 15:
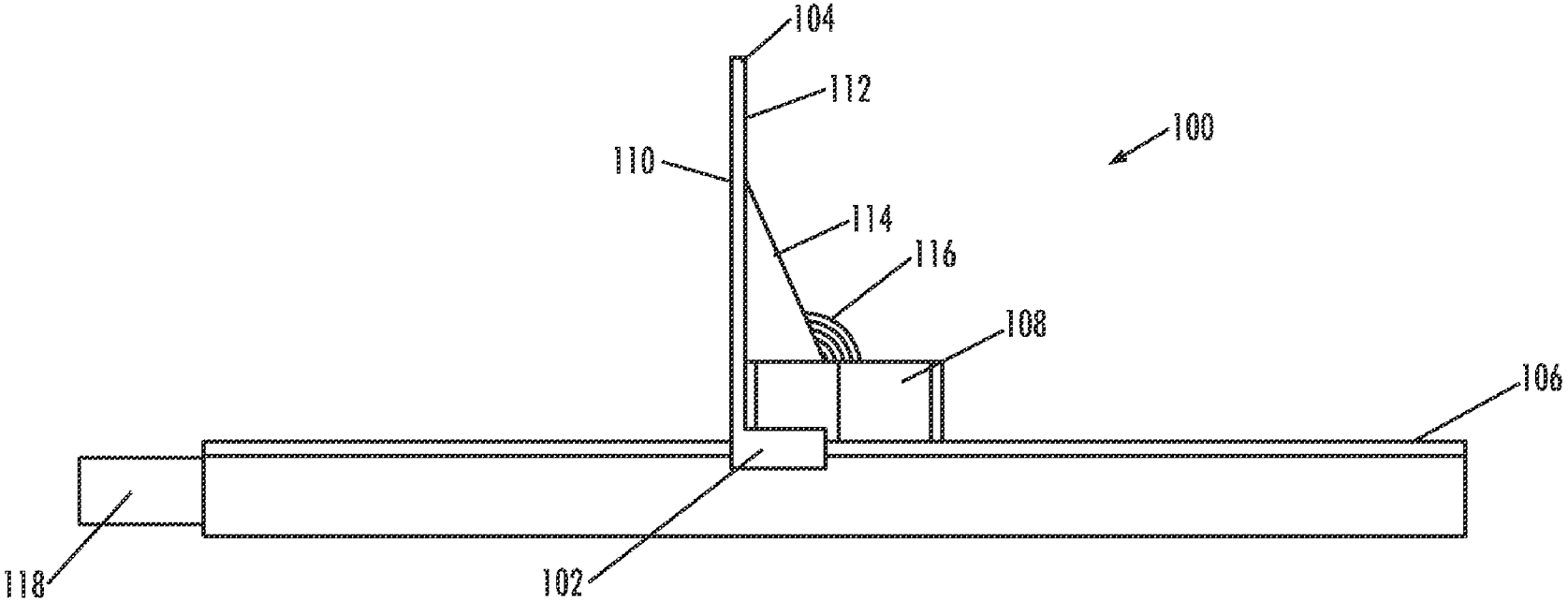
FIG. 15 is a side plan view of the pushing system of FIG. 11.
Figure 16:
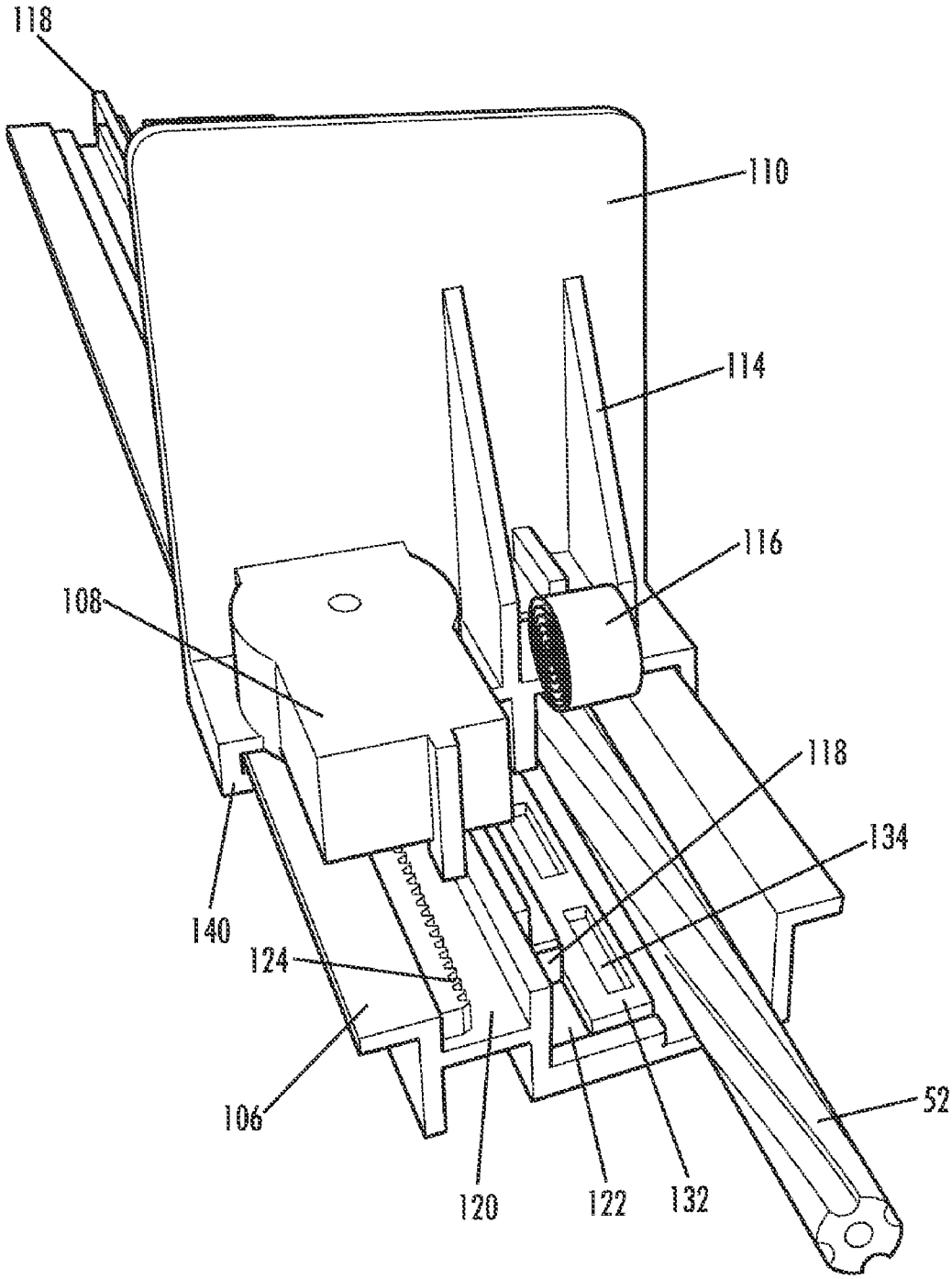
FIG. 16 is a rear perspective view of the pushing system of FIG. 11.
Figure 17:
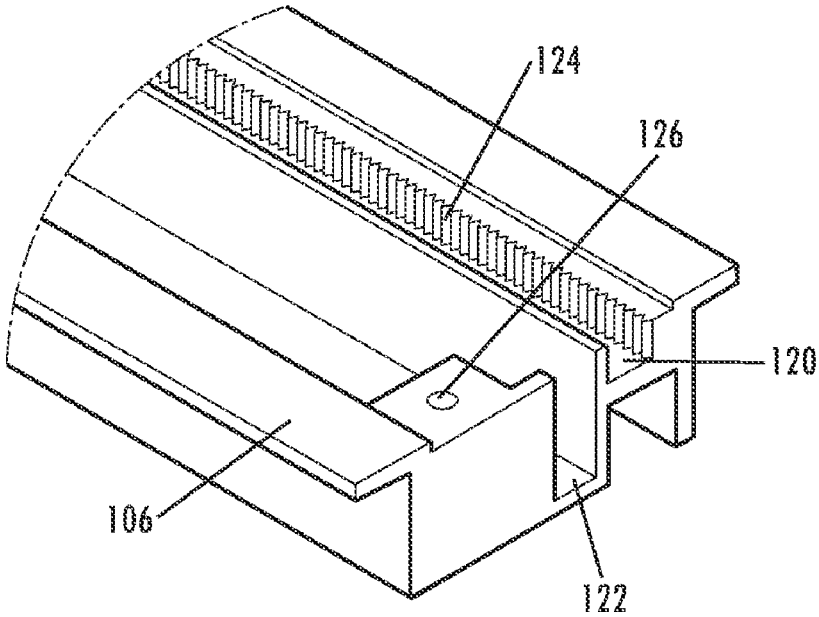
FIG. 17 is an enlarged perspective view of the track of FIG. 11.

According to another embodiment, shown in FIGS. 11-23, pushing system 100 comprises a pusher 102, a track 106, a resistance mechanism 108, and an indexing system. Pusher 102 includes a pushing ram 104 that engages product (not shown) and pushes product forward. As shown in FIG. 11, pushing ram 104 includes a front surface 110 for engaging product and a rear surface 112. In some embodiments, pusher 102 includes gusset 114 (shown in FIGS. 15, 16, and 18) for reinforcing pusher 102 and providing a housing for spring 116.

Figure 18:
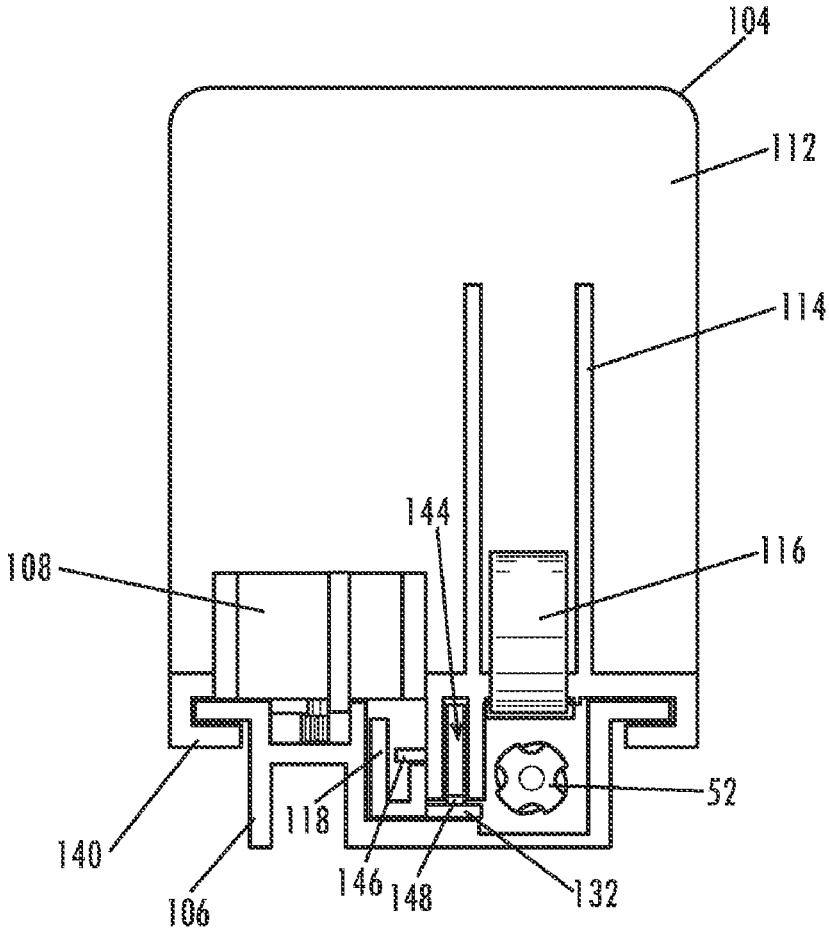
FIG. 18 is a rear plan view of the pushing system of FIG. 11.
Figure 19:
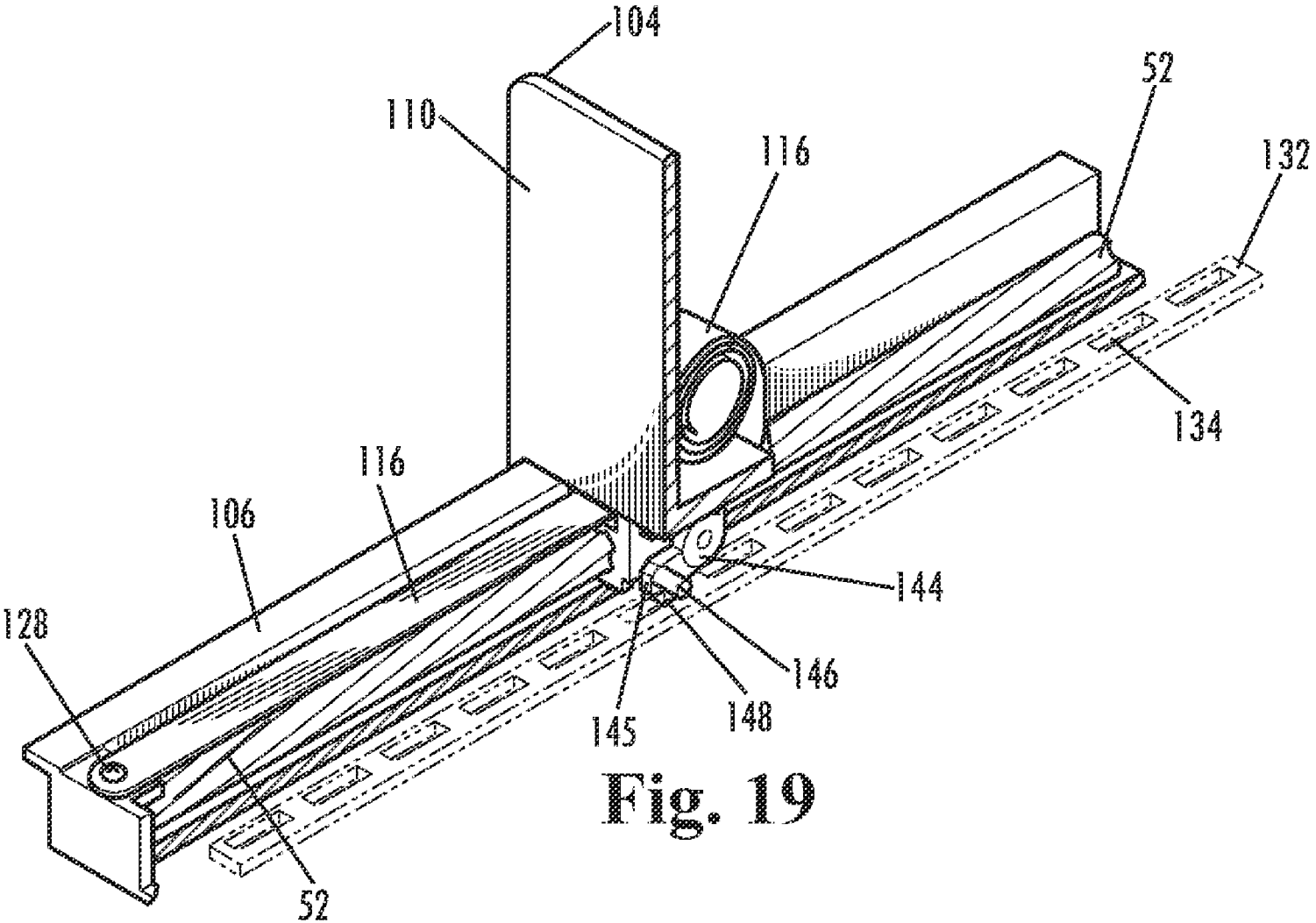
FIG. 19 is a front perspective view in partial cross-section of the pushing system of FIG. 11.
Figure 20:
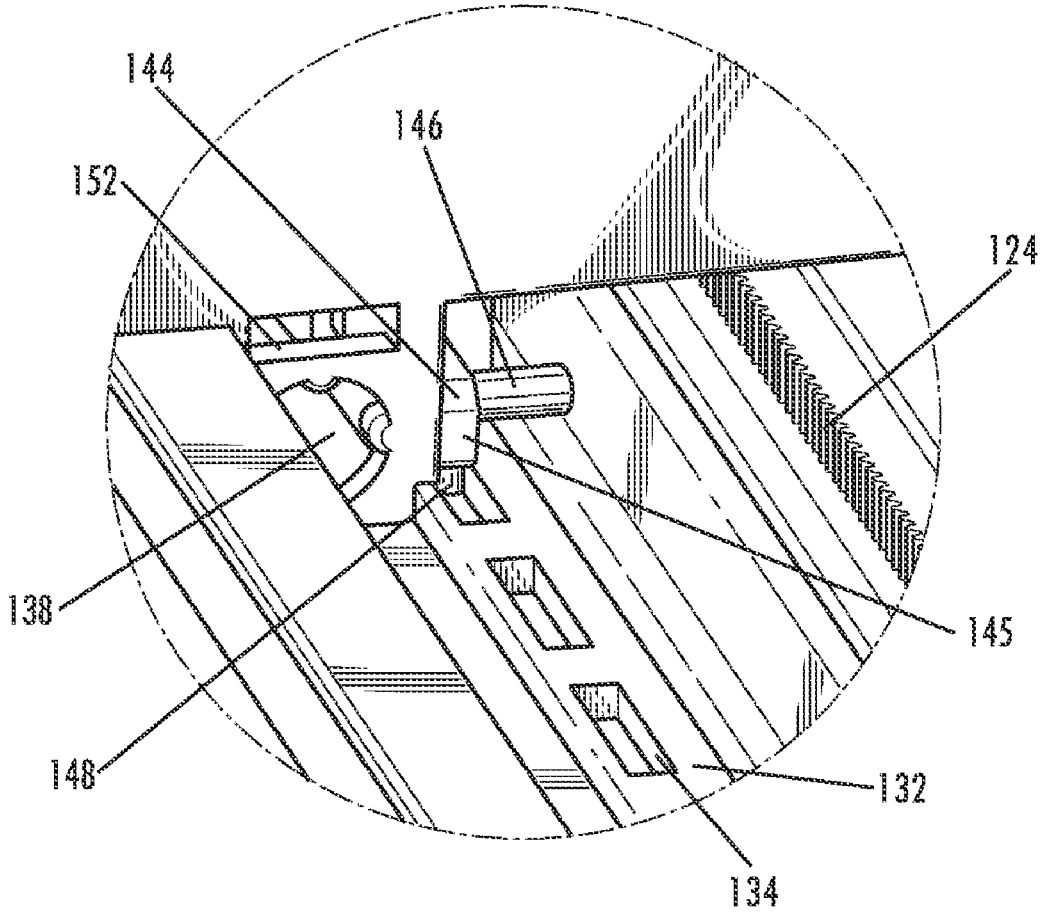
FIG. 20 is an enlarged perspective view of the pushing system of FIG. 11.

As shown in FIG. 18, extension 140 of pusher 102 extends beyond the bottom portion of pushing ram 104. In this manner, extension 140 engages track 106, so that pusher 102 is in sliding engagement with track 106.

Figure 12:
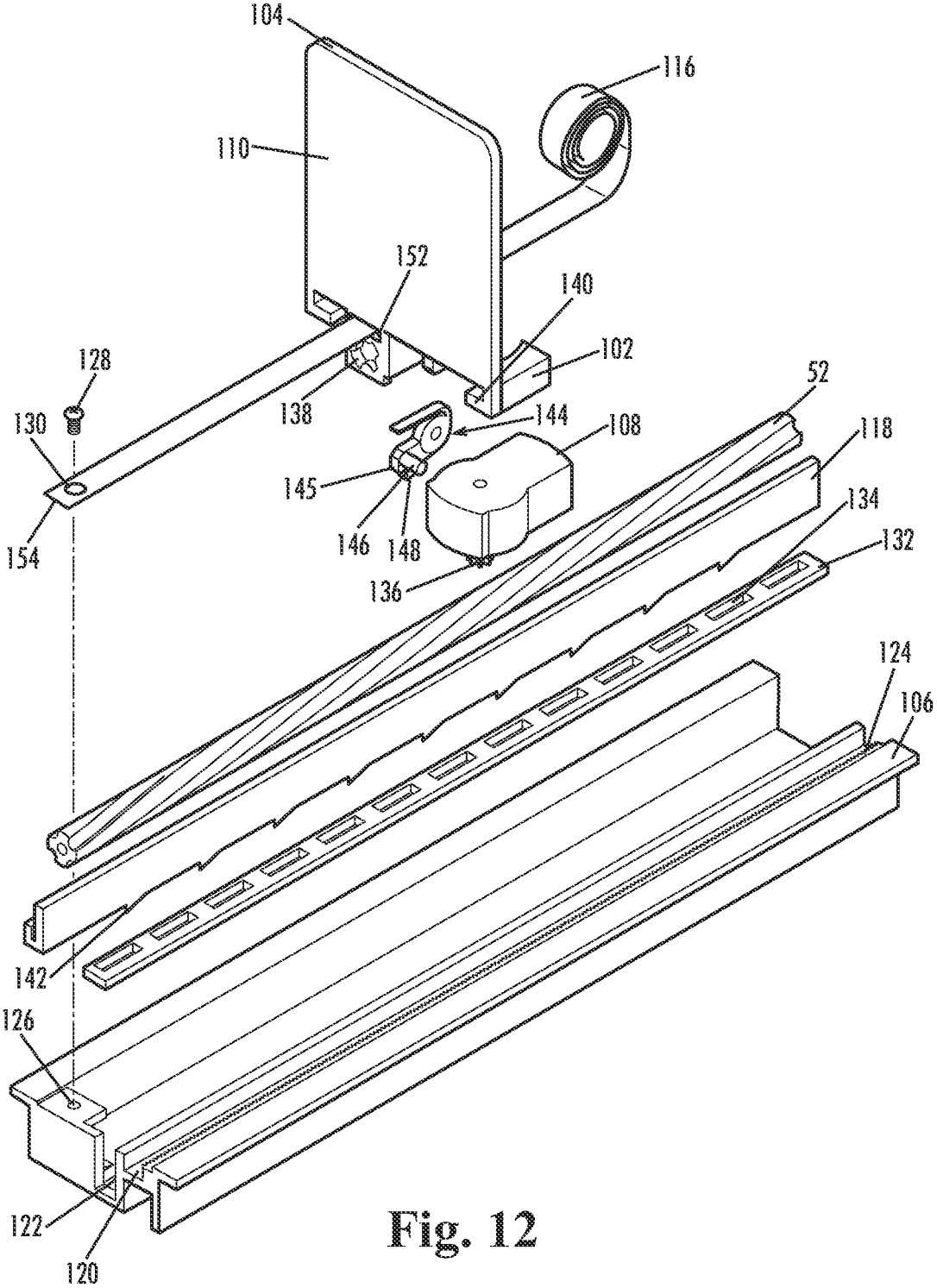
FIG. 12 is an exploded view of the pushing system of FIG. 11.
Figure 13:
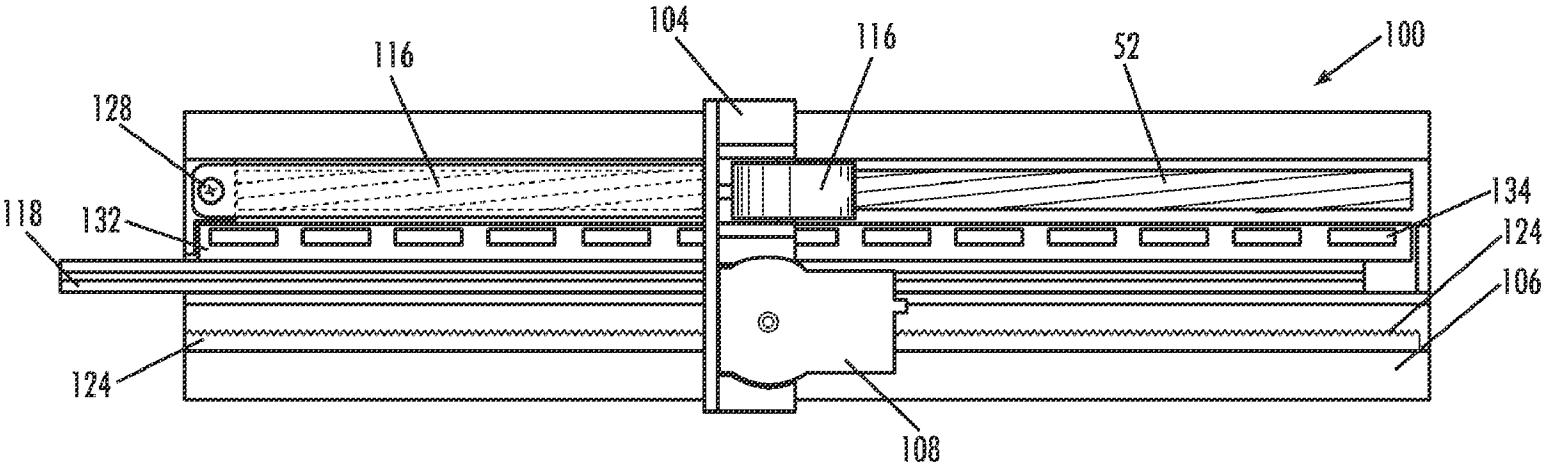
FIG. 13 is a top plan view of the pushing system of FIG. 11.
Figure 14:
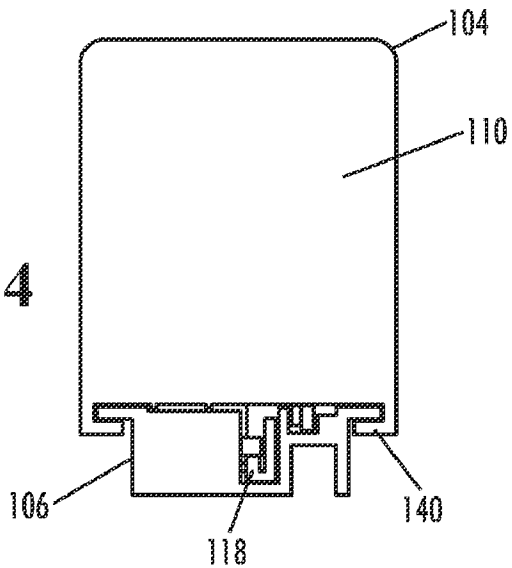
FIG. 14 is a front plan view of the pushing system of FIG. 11.
Figure 21:
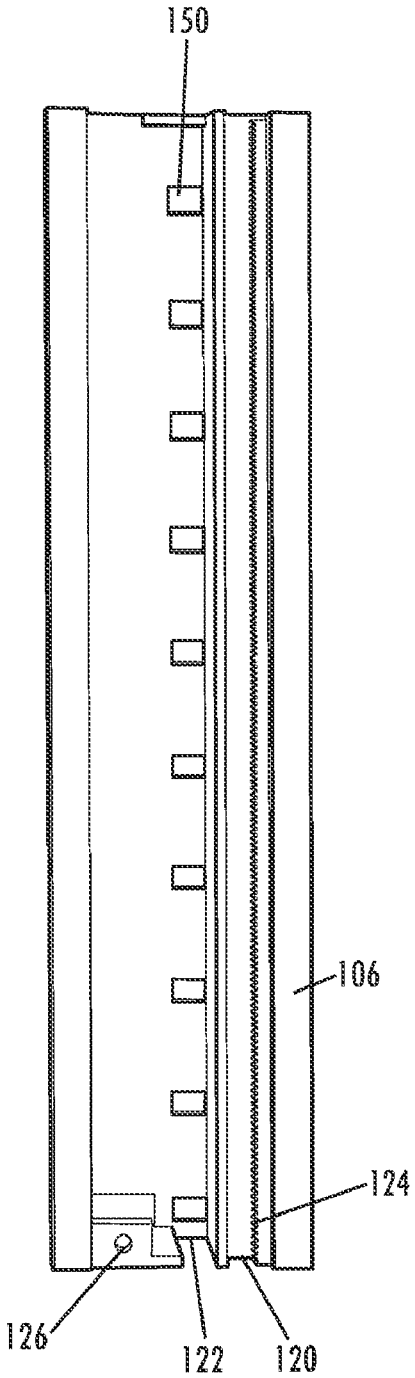
FIG. 21 is a top plan view of the track of FIG. 11.
Figure 22:
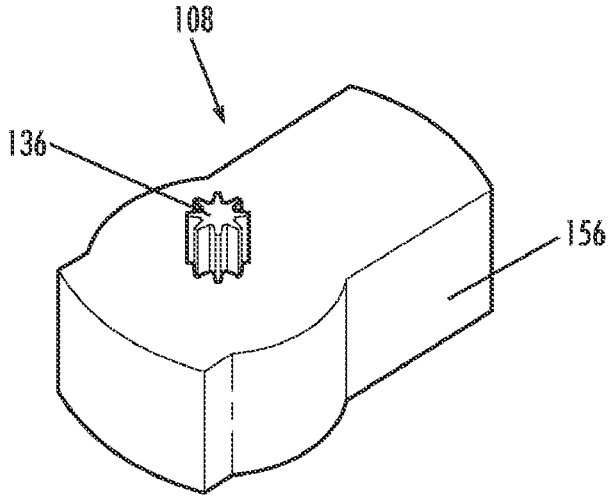
FIG. 22 is a perspective view of the resistance mechanism of FIG. 11.
Figure 23:
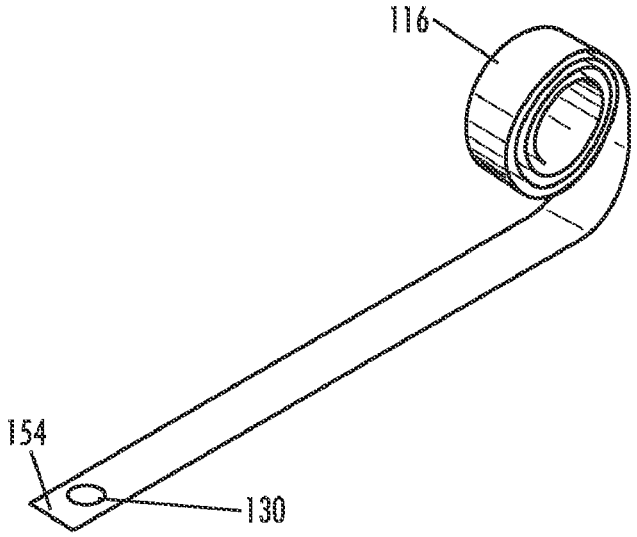
FIG. 23 is a perspective view of the spring of FIG. 11.

As shown in FIGS. 11-13 and 16-17, track 106 includes a resistance channel 120 having exposed gear teeth 124 that project into resistance channel 120 and engage external gear component 136 of the resistance mechanism 108 (shown in FIGS. 12 and 22 and further described below). The gear teeth may be positioned in various other manners along the resistance channel 120 and maintain the functionality of the pushing device. As shown in FIG. 21, track 106 also includes an index channel 122 having inclines 150 and that receives rod 118.

As shown in FIG. 12, spring 116 extends through a slot 152 in the pusher 102 and attaches to the opening 126 of the track 106. In the embodiment shown in FIG. 12, end 154 of spring 116 includes an aperture 130, through which any suitable fastener, such as screw 128, may pass to attach spring 116 to opening 126 of track 106. Spring 116 may also be attached to pushing system 100 in any other suitable manner. As explained above, movement of pusher 102 toward the back end of the track 106 unwinds spring 116 so that spring 116 urges pusher 102 in the forward direction. The spring may preferably be a constant force spring, such as those sold under the trademark Conforce®, but many other types of springs, such as a variable force spring, may also be used.

Resistance mechanism 108 is attached to pusher 102. As shown in FIG. 22, resistance mechanism 108 includes a housing 156 and an external gear component 136. Resistance mechanism 108 is positioned on pusher 102 so that external gear component 136 extends into resistance channel 120 of track 106 and engages gear teeth 124. According to certain embodiments, one such resistance mechanism is a resistance motor, such as the resistance motor Model #w217 sold by Vigor, although other types of motors may also be used. In other embodiments, resistance mechanism is a rotary damper.

As one product is selected from the front of pushing system 100, the compression of the spring 116 causes the pushing ram 104 to move forward and the external gear component 136 to rotate along gear teeth 124 of track 106. This in turn causes the remaining product to move forward along track 106. Resistance mechanism 108, however, reduces the speed of this forward progression. The internal gears of the resistance mechanism are preferably configured to provide resistance to the forward movement by limiting the rotation of the external gear component 136. Because the external gear component 136 engages gear teeth 124 of track 106 and the external gear component rotation is limited, the movement of pushing ram 104 and therefore the remaining product to the front of track 106 is slowed.

The pushing system shown in FIGS. 11-23 further includes an indexing system for controlling the movement of the pusher along a discrete length of the track 106. The indexing system, as shown in FIGS. 12-13 and 16-20, includes: a rod 118 having a plurality of protrusions 142 and being positioned within the index channel 122; an index 132 having a plurality of openings 134; and a indexing member 144. The indexing member 144 is coupled to the pusher 102 and includes a body 145, the body having a lateral arm 146 and a downward extension 148. The downward extension 148 is configured to be received within one of the plurality of openings 134 of the index 132. When the downward extension 148 of the indexing member 144 is received within one of the plurality of openings 134, forward movement of the indexing member 144 is prevented and therefore forward movement of the pusher 102 is also prevented.

When sufficient force is applied to the rod 118 so that the rod 118 moves in a generally horizontal direction toward the rear of the track 106, the inclines 150 of the track 106 engage the protrusions 142 of the rod 118 to lift the rod 118. When the rod 118 is lifted, it in turn engages the lateral arm 146 of the indexing member 144 to lift downward extension 148 of the body of the indexing member 144 out of the opening 134 of the index 132 in which the indexing member 144 was received. Once the downward extension 148 of the body of the indexing member 144 is lifted out of the opening 134, the indexing member 144 is able to move forward. In turn, the pusher 102 is also able to move forward freely, as provided for by the spring 116 and slowed by the resistance mechanism 108, until the indexing member 144 reaches the next opening 134 of the index 132. Upon reaching the next opening 134, the downward extension 148 of the body of the indexing member 144 is received within the opening 134 of the index 132 and again prevents the indexing member 144 from moving forward, which in turns prevents further forward movement of the pusher 102.

The distance between the openings 134 may correspond to the depth of the product housed by the pushing system. Therefore, the pusher 102 may only move a discrete distance each time the indexing mechanism is activated, with the discrete distance corresponding to the depth of an individual product, so that only one product is capable of moving forward at a time.

In some embodiments, the indexing member 144 is a spring-loaded actuator. The rod 118 may be connected to an access door or a button accessible to the user, so that upon activation, the rod 118 activates the indexing mechanism so that the pusher 102 advances one product forward. To dispense another product, the user must re-activate the indexing system by either opening the access door or pressing the button. In other embodiments, a push button, delivery chute, or other mechanism can be used to activate the indexing system.

In this way, the pushing system 100 is configured so that only one product may be dispensed at a time. This requires someone who wants to remove more than one product from the pushing system to wait between removal of each product, which has been found to be a substantial deterrence to product theft.

In certain embodiments, as shown in FIGS. 11-13 and 16, pushing system 100 includes a shaft 52 that extends through an opening 138 in the pusher 102. The shaft 52 engages a rotary potentiometer, or other suitable device, for inventory control. The shaft 52 may be helix shaped and is held at either end of the track so that the shaft 52 can rotate without being impeded. In these embodiments, the pusher 102 has an opening 138 in a corresponding shape (i.e., helix geometry plus a small amount of tolerance) so that when the pusher 102 moves in a forward or backward direction, the linear motion is translated into a rotary motion of the shaft 52. The shaft 52 may then be connected to an electronic assembly containing a rotary potentiometer. The pitch of the shaft 52 is such that the revolution of the shaft 52 is slightly less than 360°, as determined by the most forward and rear position of the pusher 102 on the track. Known voltage values can then be translated into counts of the products on the track, which stores information about when product is added or removed from the track.

Figure 24:
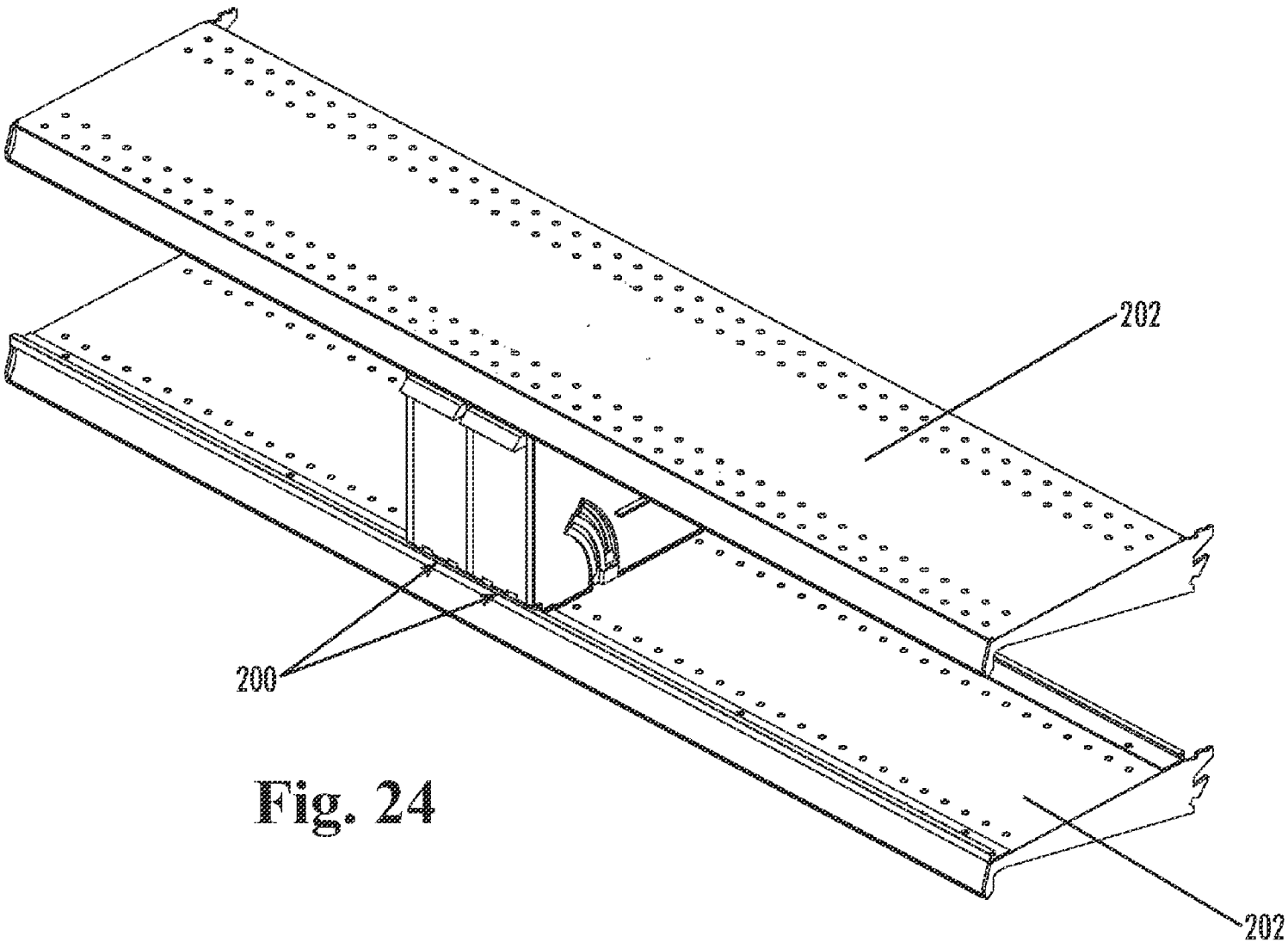
FIG. 24 is a perspective view of a plurality of pushing assemblies, according to an alternate embodiment of the invention.
Figure 25:
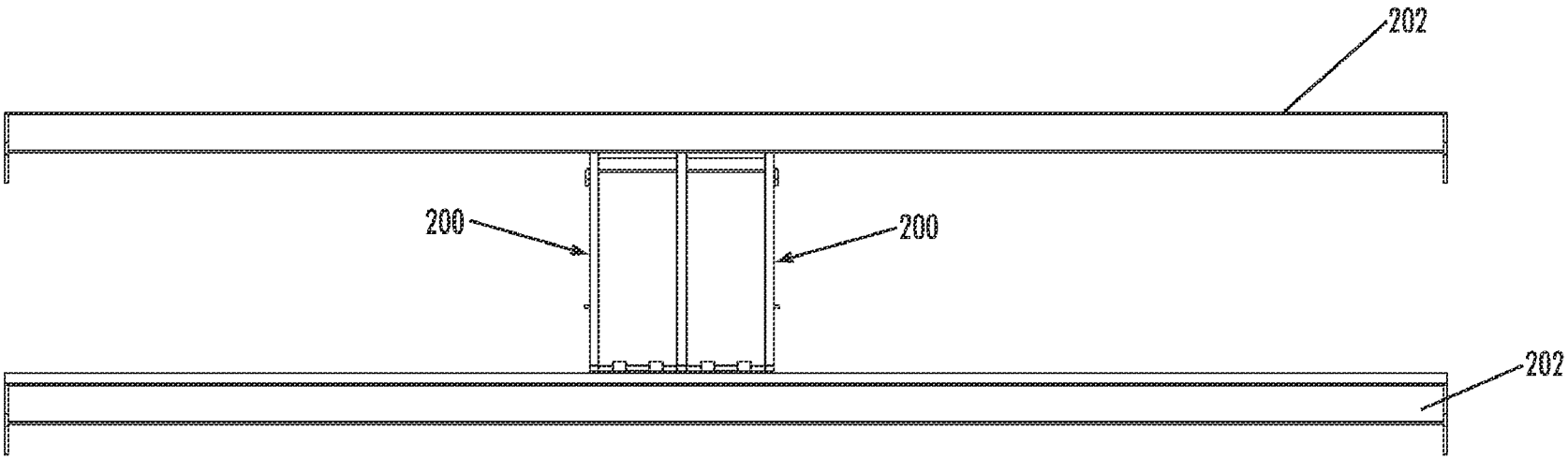
FIG. 25 is a front plan view of the pushing assemblies of FIG. 24.

In another embodiment of the invention, shown in FIGS. 24-47, one or more pushing assemblies 200 may be positioned between two retail shelving units 202 as shown in FIGS. 24 and 25. Alternatively, one or more pushing assemblies 200 may be positioned on a single shelving unit, or placed on any type of surface such as a countertop. Pushing assembly 200, shown in FIGS. 24-47, comprises a pusher 214, a track 216, a resistance mechanism 230, a stop 254, and a door assembly 218. In some embodiments, resistance mechanism 230 is not used. In some embodiments, pushing assembly 200 is used with a cover 212 and/or one or more dividers 204.

Figure 26:
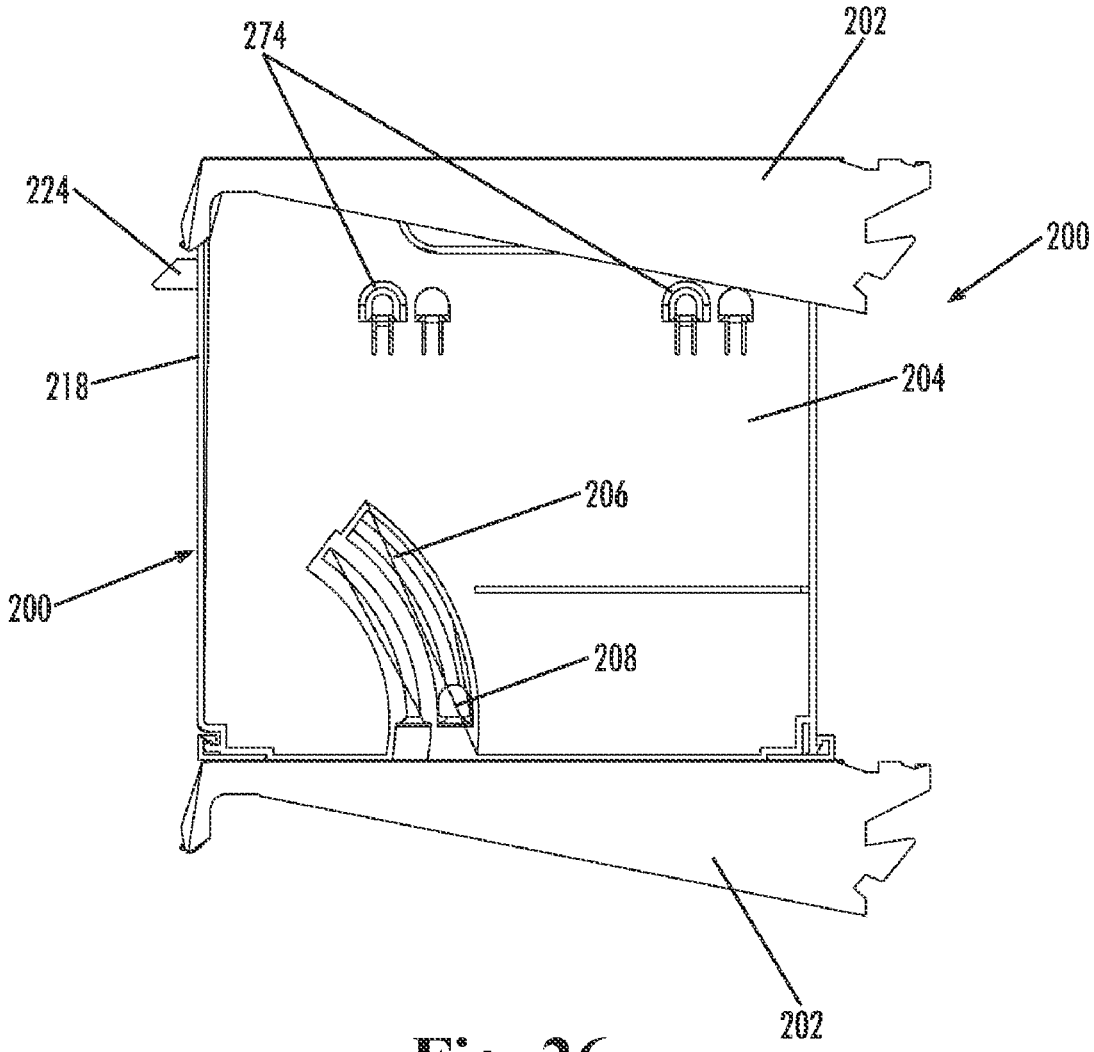
FIG. 26 is a side plan view of the pushing assemblies of FIG. 24.
Figure 27:
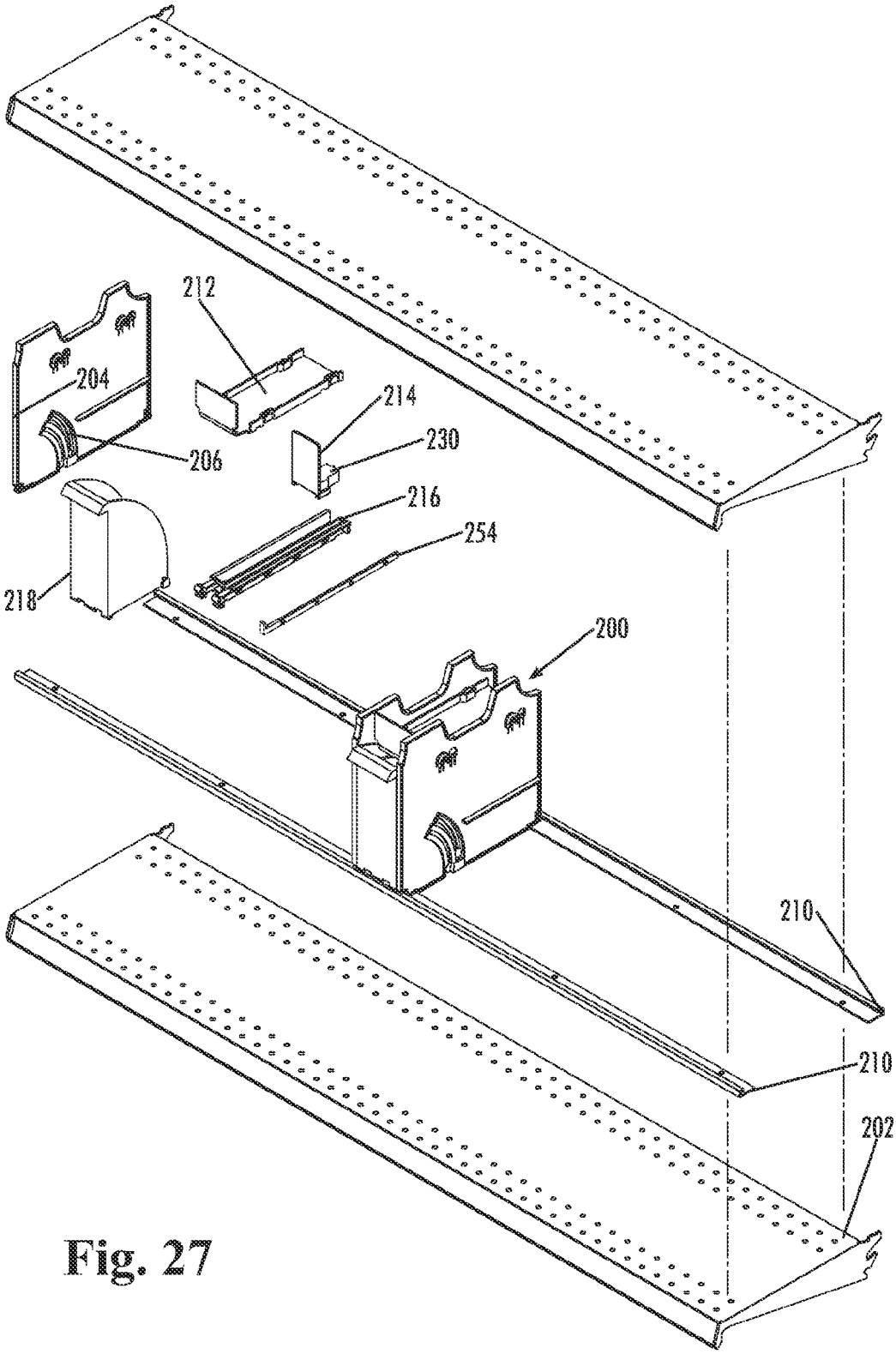
FIG. 27 is an exploded view of the pushing assemblies of FIG. 24.
Figure 28:
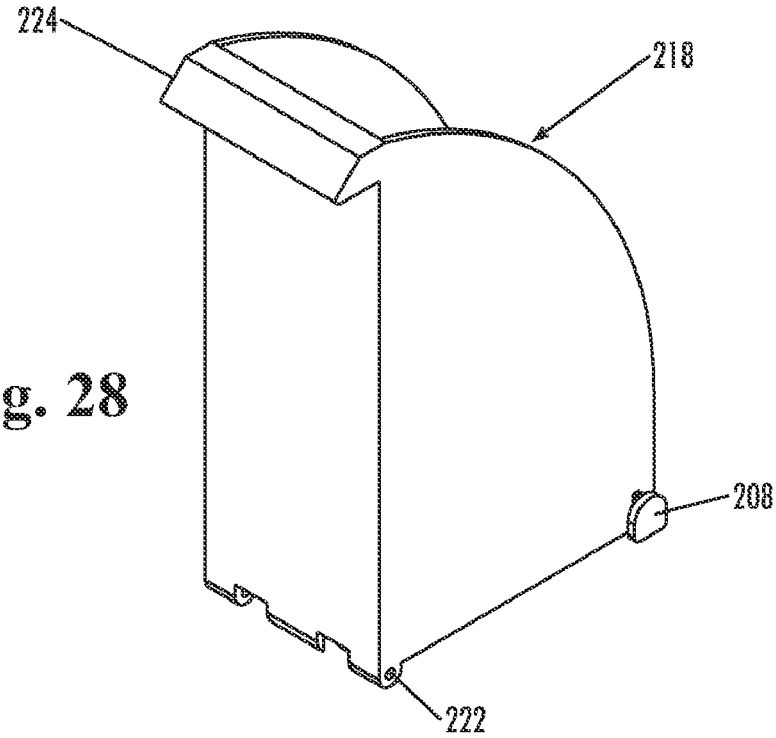
FIG. 28 is a perspective view of the door assembly of FIG. 24.
Figure 29:
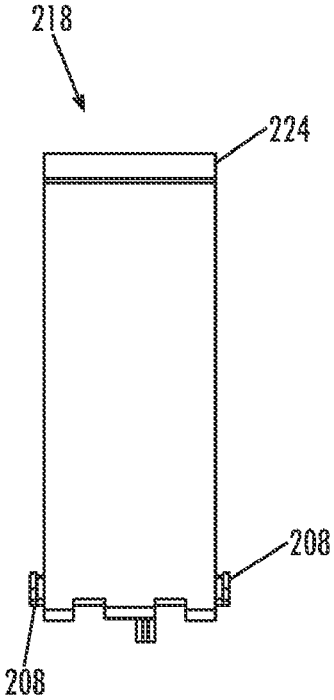
FIG. 29 is a front plan view of the door assembly of FIG. 28.
Figure 43:
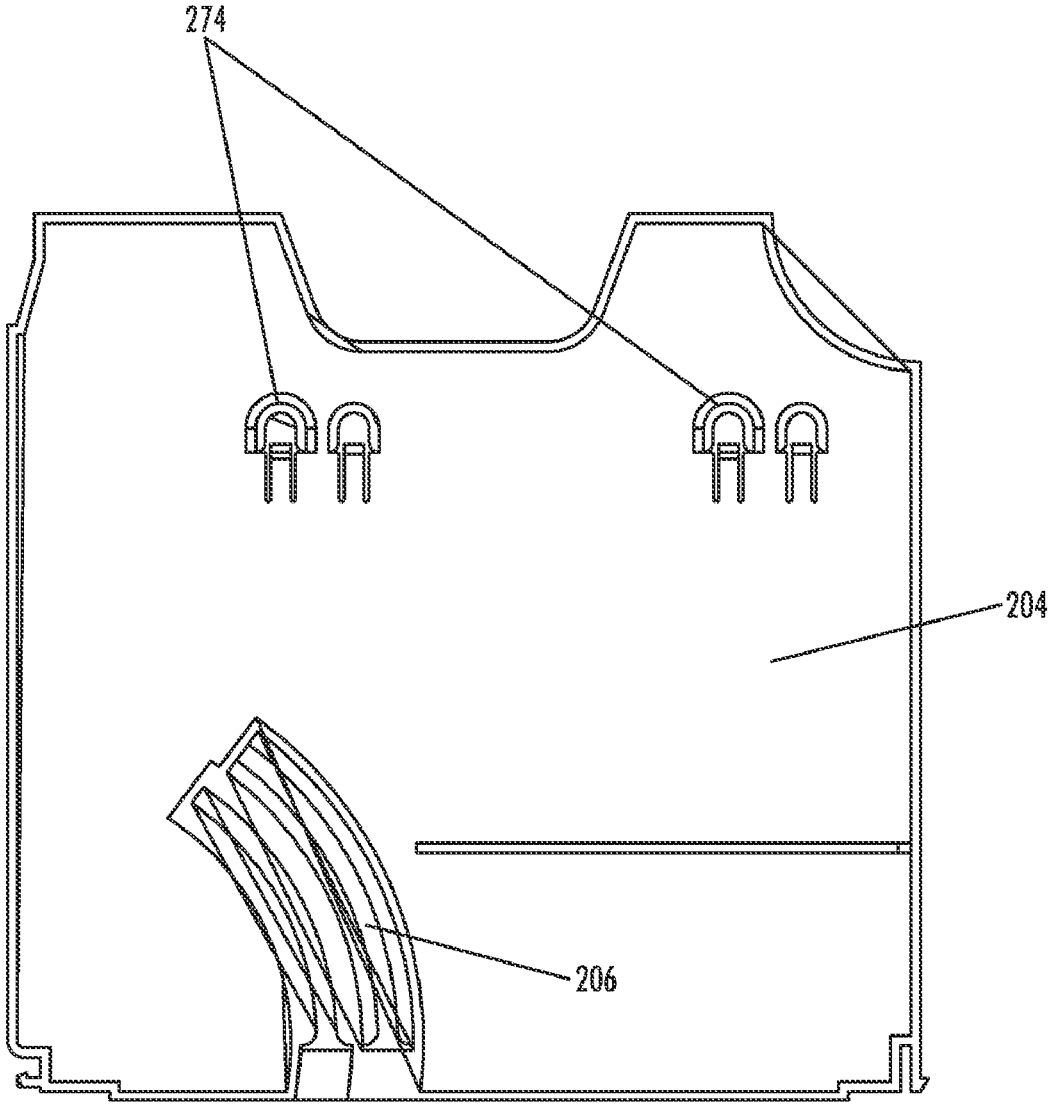
FIG. 43 is a side plan view of the divider of FIG. 24.

For example, as shown in FIGS. 26 and 43, a divider 204 may be positioned on one or both sides of the pushing assembly 200 to separate adjacent assemblies. As shown in FIG. 43, the divider 204 includes an opening 206 and one or more securing extensions 274, further described below.

Figure 35:
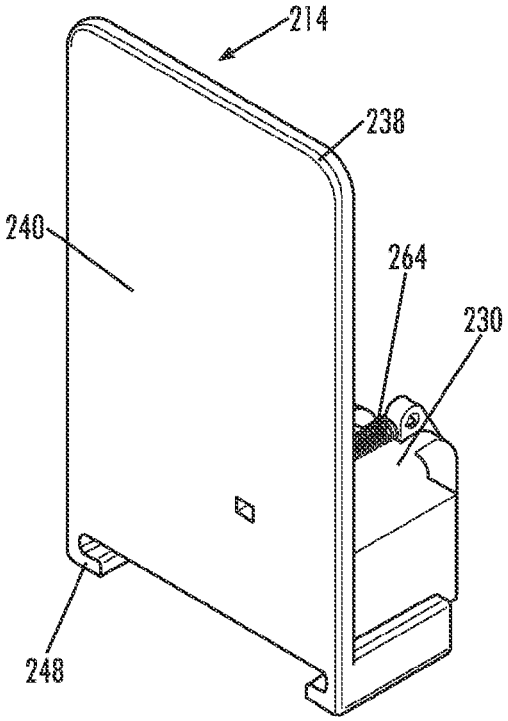
FIG. 35 is a front perspective view of the pusher of FIG. 24.
Figure 36:
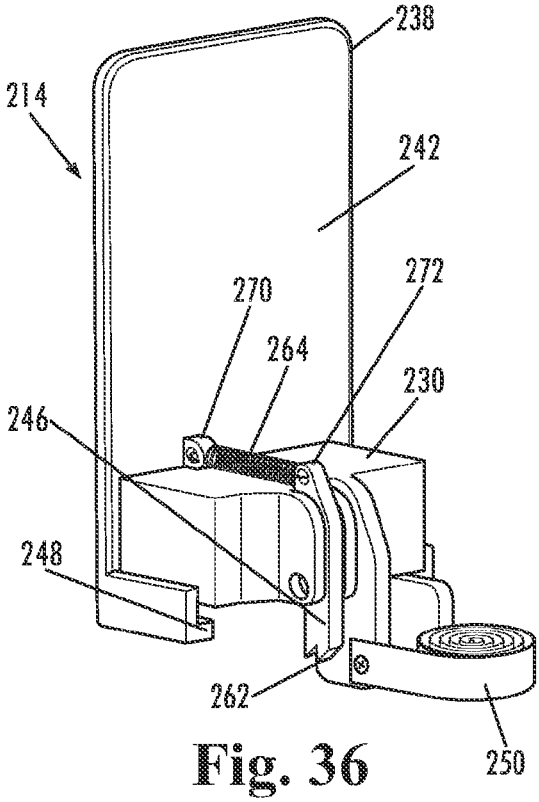
FIG. 36 is a rear perspective view of the pusher of FIG. 24.

As shown in FIGS. 35-38, pusher 214 includes a pushing ram 238 that engages product (not shown) and pushes product forward. As shown in FIGS. 35 and 36, pushing ram 238 includes a front surface 240 for engaging product and a rear surface 242. In one embodiment, shown in FIGS. 35-38, the pushing ram 238 is a rectangular plate, although other suitable shapes and geometries may also be used.

Figure 37:
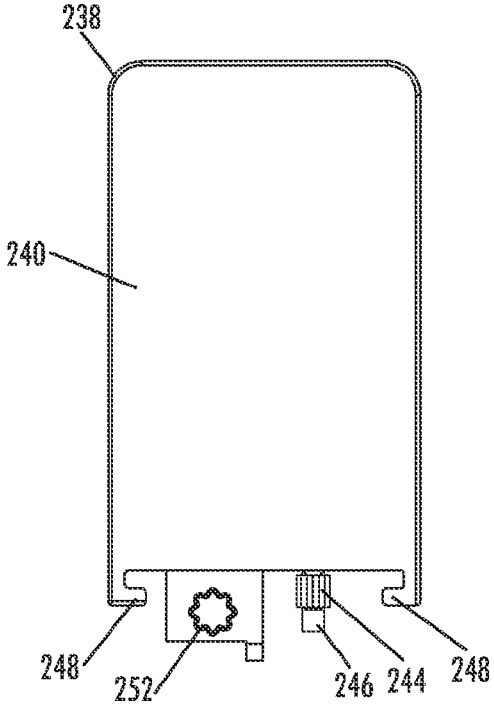
FIG. 37 is a front plan view of the pusher of FIG. 35

As shown in FIGS. 35 and 37, extension 248 of pusher 214 extends beyond the bottom portion of pushing ram 238. In this manner, extension 248 engages track 216, so that pusher 214 is in sliding engagement with track 216.

Figure 33:
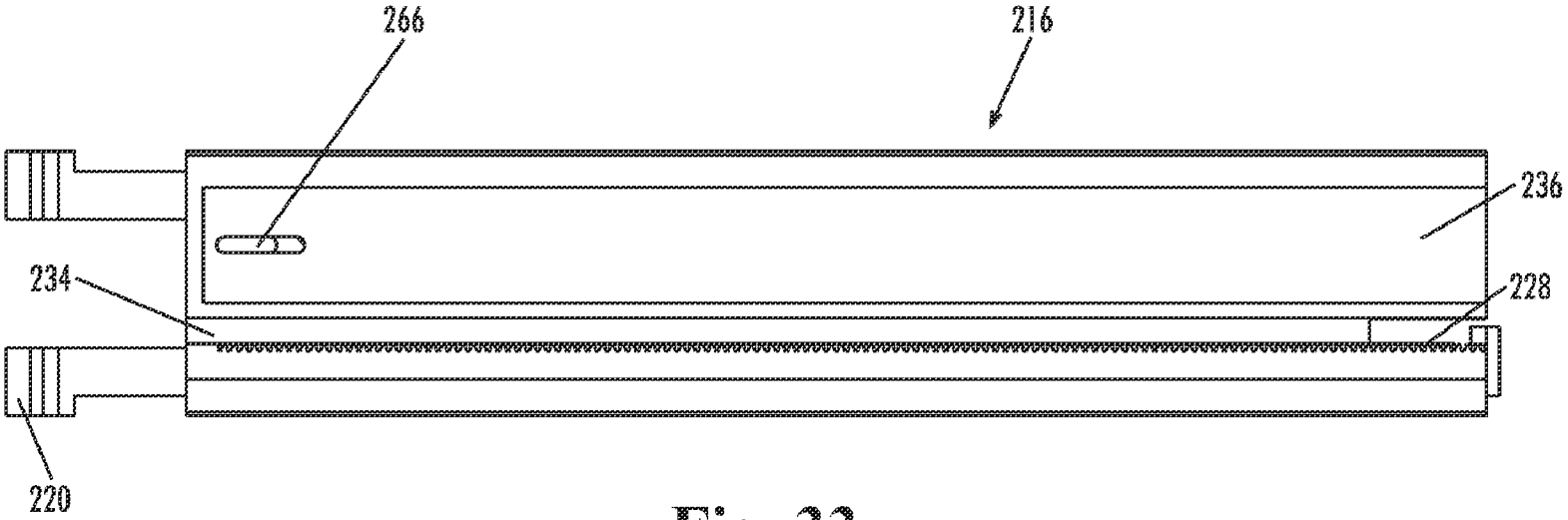
FIG. 33 is a top plan view of the track of FIG. 32.
Figure 34:
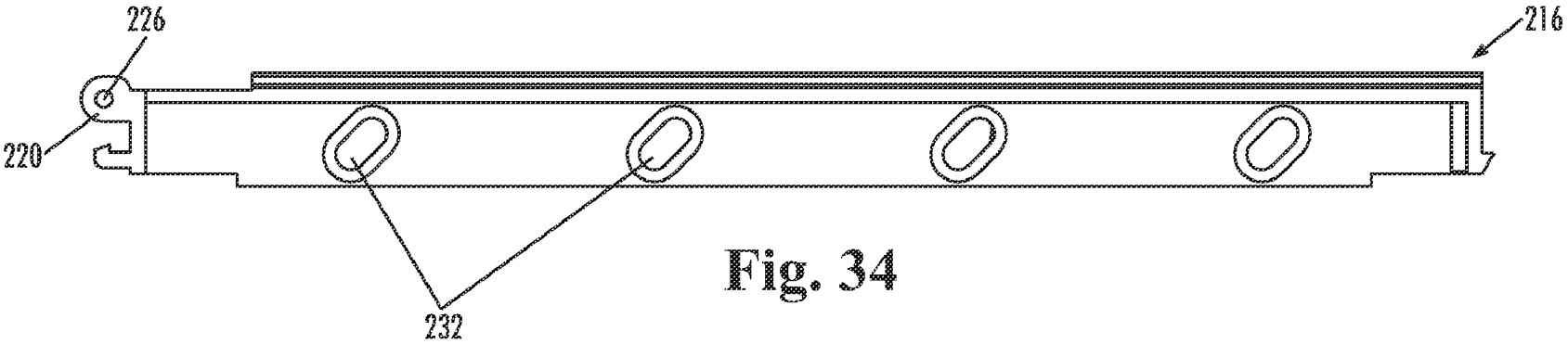
FIG. 34 is a side plan view of the track of FIG. 35.
Figure 39:
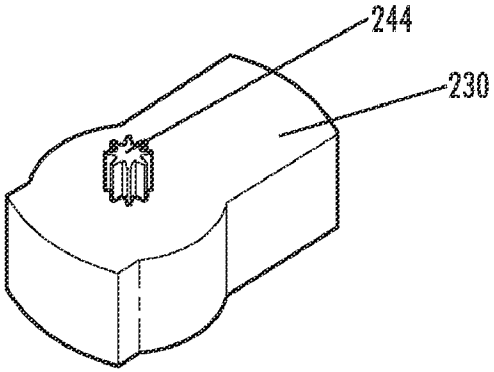
FIG. 39 is a perspective view of the resistance mechanism of FIG. 24.

As shown in FIG. 33, track 216 includes a resistance channel 234 having exposed gear teeth 228 that project into resistance channel 234 and engage external gear component 244 of the resistance mechanism 230, shown in FIG. 39 and further described below. The gear teeth 228 may be positioned in various other manners along the resistance channel 234 and maintain the functionality of the device.

Figure 40:
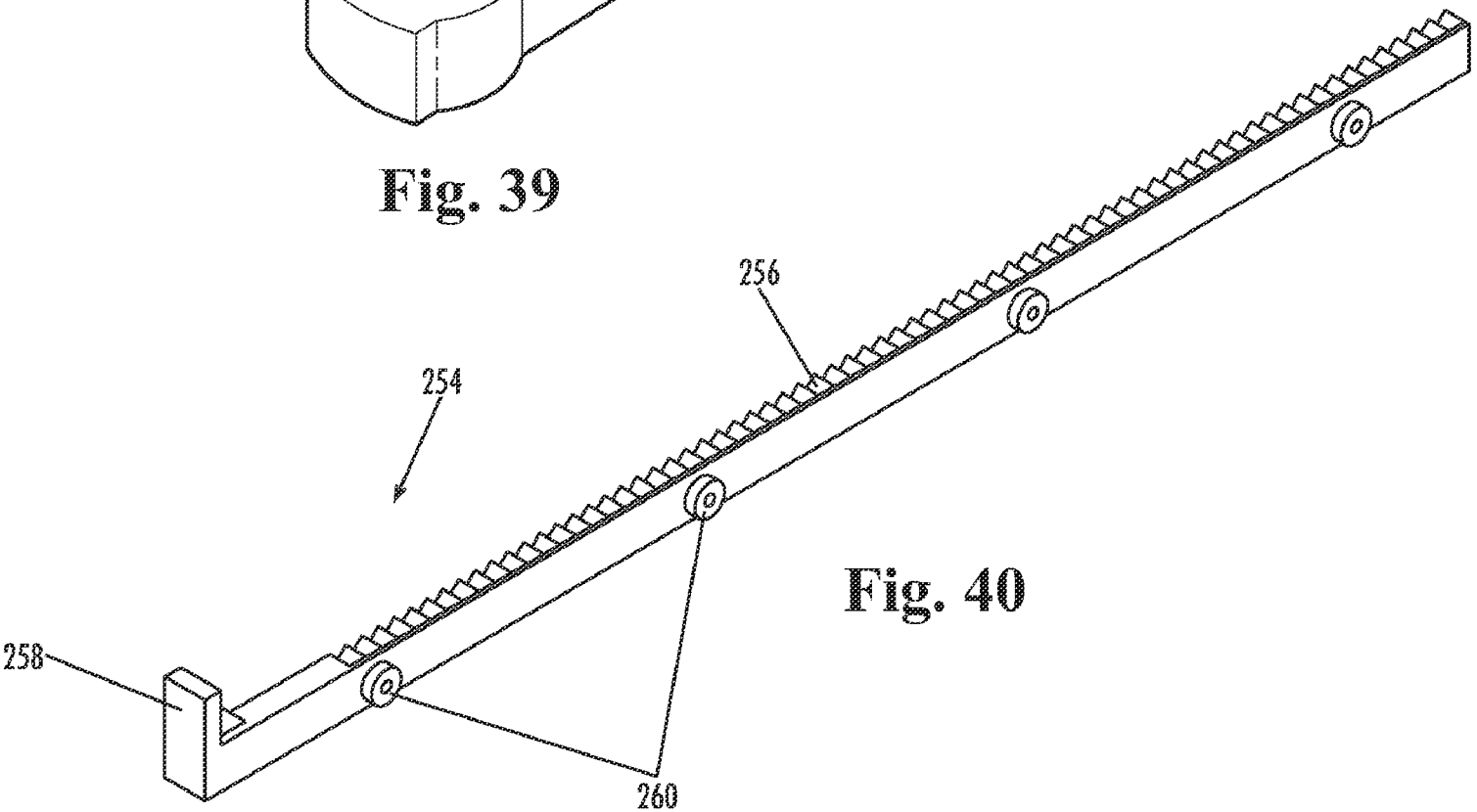
FIG. 40 is a perspective view of the stop mechanism of FIG. 24.
Figure 41:
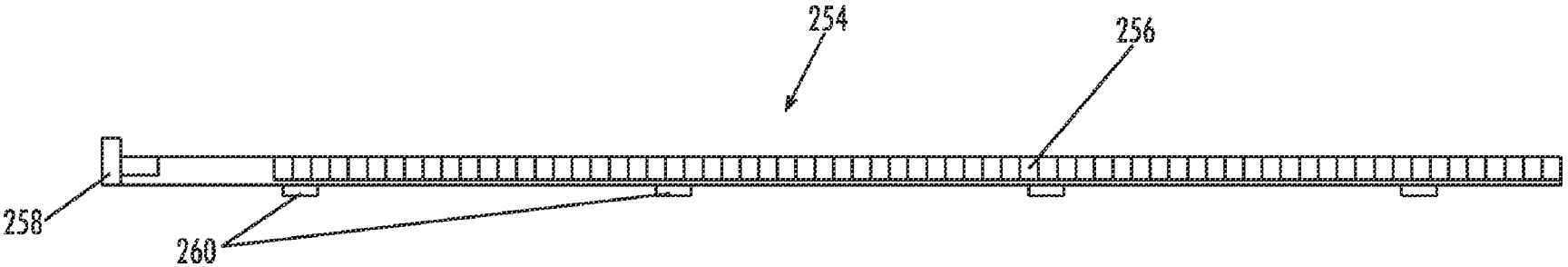
FIG. 41 is a top plan view of the stop mechanism of FIG. 40.
Figure 42:
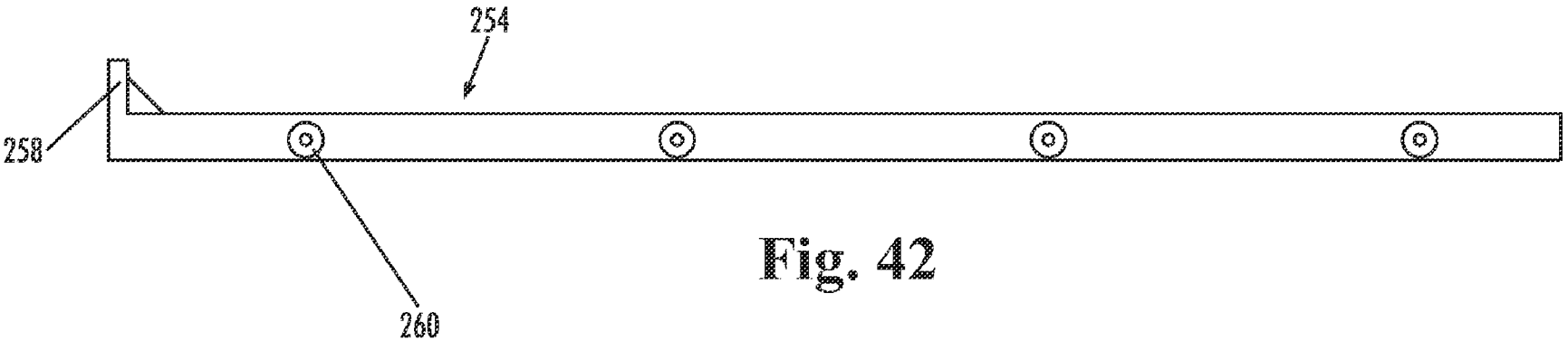
FIG. 42 is a side plan view of the stop mechanism of FIG. 40.

Resistance channel 234 may also receive stop 254, shown in FIGS. 40-42. As shown in FIG. 40, stop 254 includes a plurality of engagement surfaces 256, which form generally a sawtooth shape in cross section. Stop 254 also includes a front face 258, which may extend beyond the resistance channel 234. Engagement surfaces 256 are positioned to engage projections 262 extending from brake 246 of pusher 214 (shown in FIGS. 36 and 38). Stop 254 also includes one or more protrusions 260, which may be located on the side of stop 254, as shown in FIG. 40. As described below, these protrusions are shaped and sized to fit within one or more slots 232 in the side of track 216, shown in FIG. 34.

Figure 38:
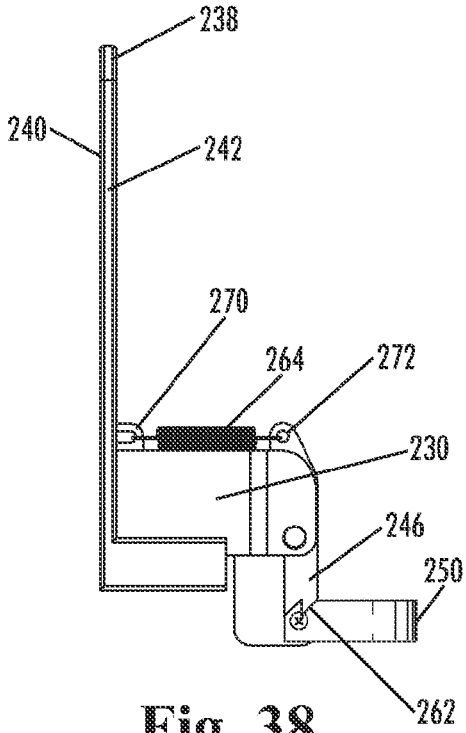
FIG. 38 is a side plan view of the pusher of FIG. 35.

As shown in FIG. 38, one end of spring 250 is attached to the pusher 214 in any suitable manner, such as, but not limited to, by a screw. When in the coiled position, spring 250 may be positioned around a post 266 in channel 236 of track 216 (FIG. 33). Movement of pusher 214 toward the back end of the track 216 unwinds spring 250 so that when released, spring 250 urges pusher 214 in the forward direction. Spring 250 may be positioned anywhere along track 216 in relation to pusher 214, so that spring 250 is capable of either "pushing" or "pulling" pusher 214 forward. The spring preferably may be a constant force spring, such as those sold under the trademark Conforce®, but many other types of springs, such as a variable force spring, may also be used.

Optional resistance mechanism 230 is attached to pusher 214. As shown in FIG. 39, resistance mechanism 230 includes external gear component 244. As shown in FIGS. 35-38, resistance mechanism 230 is positioned on pusher 214 so that external gear component 244 extends into resistance channel 234 of track 216 and engages gear teeth 228. According to certain embodiments, one such resistance mechanism is a conventional resistant motor, such as used in toys, such as the resistance motor Model #w217 sold by Vigor, although other types of motors may also be used. In other embodiments, resistance mechanism 230 is a rotary damper.

As one product is selected from the front of pushing assembly 200, the compression of the spring 250 causes the pushing ram 238 to move forward and the external gear component 244 to rotate along gear teeth 228 of track 216. The movement of pushing ram 238 advances remaining product along track 216. The speed of this forward movement is controlled and reduced by resistance mechanism 230. The internal gears of the resistance mechanism 230 are preferably configured to provide resistance to the forward movement by limiting the rotation of the external gear component 244. Because the external gear component 244 engages gear teeth 228 of track 216 and the external gear rotation is limited, the movement of pushing ram 238 and therefore the remaining product to the front of track 216 is slowed.

Product can be loaded in pushing assembly 200 by forcing pushing ram 238 backwards along track 216 and placing multiple units of the product against the pushing ram 238. As described above, spring 250 causes the pushing ram 238 to exert force on the products towards the front of the track 216. Resistance mechanism 230 preferably allows pushing ram 238 to be forced backwards freely for loading of the product.

The pushing assembly 200 shown in FIGS. 24-47 includes a stop 254 that may be engaged to prevent the pusher 214 from advancing product forward. As explained above and shown in FIG. 40, the stop 254 includes engagement surfaces 256 that form generally a sawtooth shape in cross section. Stop 254 is positioned within resistance channel 234 so that the protrusions 260 of the stop 254 are received in sloped slots 232 on the side of the track 216. When the stop 254 is in a disengaged position, the protrusions 260 of the stop are located at one end of slots 232. When sufficient force is applied to the front face 258 of the stop 254, the protrusions 260 on the side of the stop 254 move upward from one end of slots 232 to the other end of slots 232. Because slots 232 are sloped along track 216, movement of the protrusions 260 upward along the length of the slots 232 lifts the stop 254 vertically from the disengaged position to an engaged position. In this way, when horizontal force is applied to the front face 258 of stop 254, such as by opening door assembly 218 as described further below, stop 254 moves both horizontally toward the rear of the track 216 and upward at the same time. When stop 254 is raised to the engaged position, the engagement surfaces 256 of the stop 254 raise to engage the projections 262 of the brake 246 that extend into resistance channel 234. When projections 262 of the brake 246 engage the engagement surfaces 256 of the stop 254, stop 254 prevents forward movement of the pusher 214.

In some embodiments, pushing assembly 200 may include a door assembly 218, such as the one shown in FIGS. 27-31, or other suitable structure, that blocks access to the product when the door assembly 218 is in the closed position. Door assembly 218 may be aligned with the track 216 so that the opening 222 of door assembly 218 (FIG. 28) aligns with opening 226 of track 216 (shown in FIG. 34). A pin (not shown) may then be inserted through openings 222 and 226 to secure the door assembly 218 to the track 216. Door assembly 218 further may include a ledge 224, which is accessible to a user. Door assembly 218 may also include a protrusion 208 that is shaped and sized to be received within opening 206 of the divider 204 (FIG. 43). In this manner, when a user pulls ledge 224 to open door assembly 218, door assembly 218 pivots forward as protrusion 208 moves along curved opening 206 of divider 204.

Figure 30:
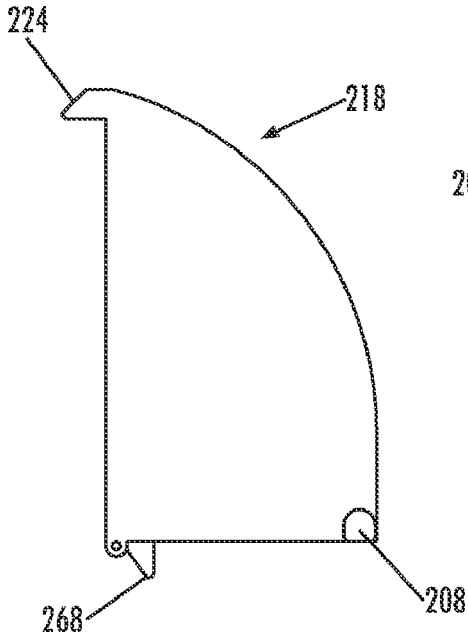
FIG. 30 is a side plan view of the door assembly of FIG. 28.
Figure 31:
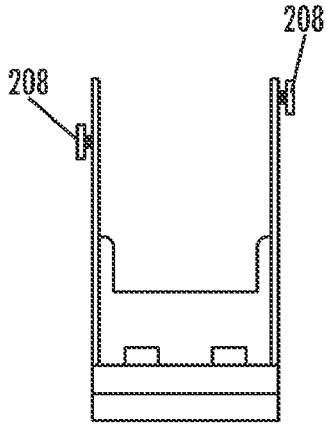
FIG. 31 is bottom plan view of the door assembly of FIG. 28.
Figure 32:
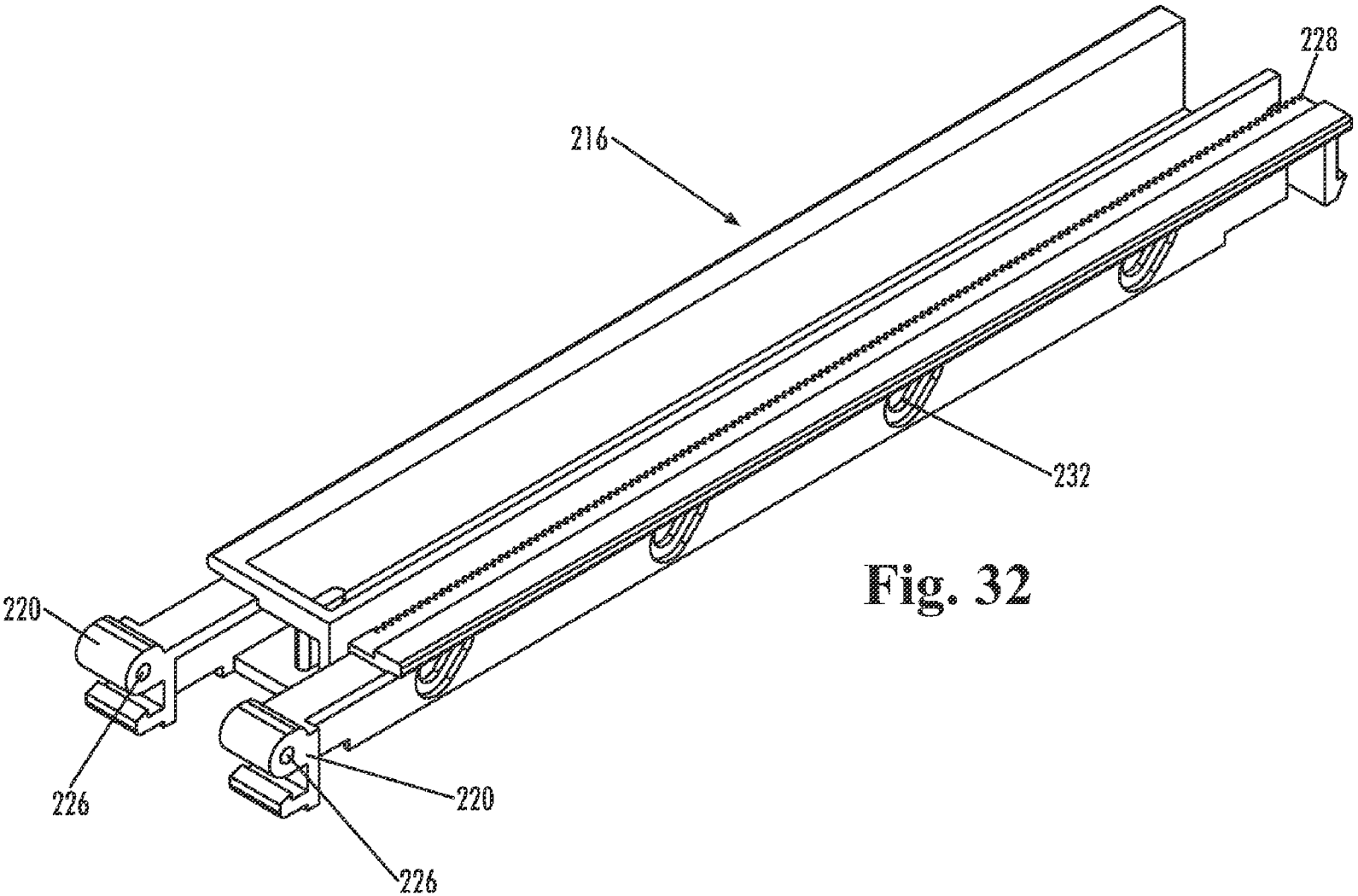
FIG. 32 is a perspective view of the track of FIG. 24.

Door assembly 218 may further include a lateral extension 268 (FIG. 30). Lateral extension 268 is positioned so that when door assembly 218 is moved to the open position, lateral extension 268 rotates to engage the front face 258 of stop 254. In this way, when the door assembly 218 is open, lateral extension 268 applies a generally horizontal force to stop 254 so that the stop 254 moves upward and forward along slot 232 into its engaged position. Once in the engaged position, the engagement surfaces 256 of stop 254 engage the protrusions 262 of brake 246 to stop forward movement of the pusher 214, as described above. As a result, only the forward-most product is accessible to a user when the door assembly 218 is open. When the door assembly is closed, lateral extension 268 of the door assembly 218 does not engage stop 254 and therefore stop 254 remains in the disengaged position and the pusher 214 is free to move forward due to the action of the spring 250 and as slowed by the resistance mechanism 230, as described above. In this way, the pushing assembly 200 is configured so that only one product may be removed at a time. The pushing assembly 200 is also configured so that product may only be removed when at the front of the track 216. This requires someone who wants to remove more than one product from the pushing system to wait for several seconds between removal of each product, which has been found to be a substantial deterrence to product theft. Moreover, door assembly 218 may include a spring or other mechanism that urges the door assembly 218 to its closed position.

In some embodiments, as shown in FIGS. 35-36 and 38, pusher 214 also includes a second spring 264 attached at attachment points 270 and 272. Attachment point 272 is coupled to brake 246. Second spring 264 functions as an override feature when the door assembly 218 is in the open position and the stop 254 is engaged to prevent forward movement on the pusher 214. The second spring 264 allows the brake 246 to pivot when force is applied to the pusher 214 in a rearward direction so that the brake 246 is no longer engaged with the engagement surfaces 256 of the stop 254. Thus, when a force is applied to pusher 214 in a rearward direction, pusher 214 is not prevented from moving toward the back of the track 216, even while the stop 254 is engaged. In this manner, a retailer or other person can load additional product into the pushing assembly 200 when the door assembly 218 is open.

Figure 44:
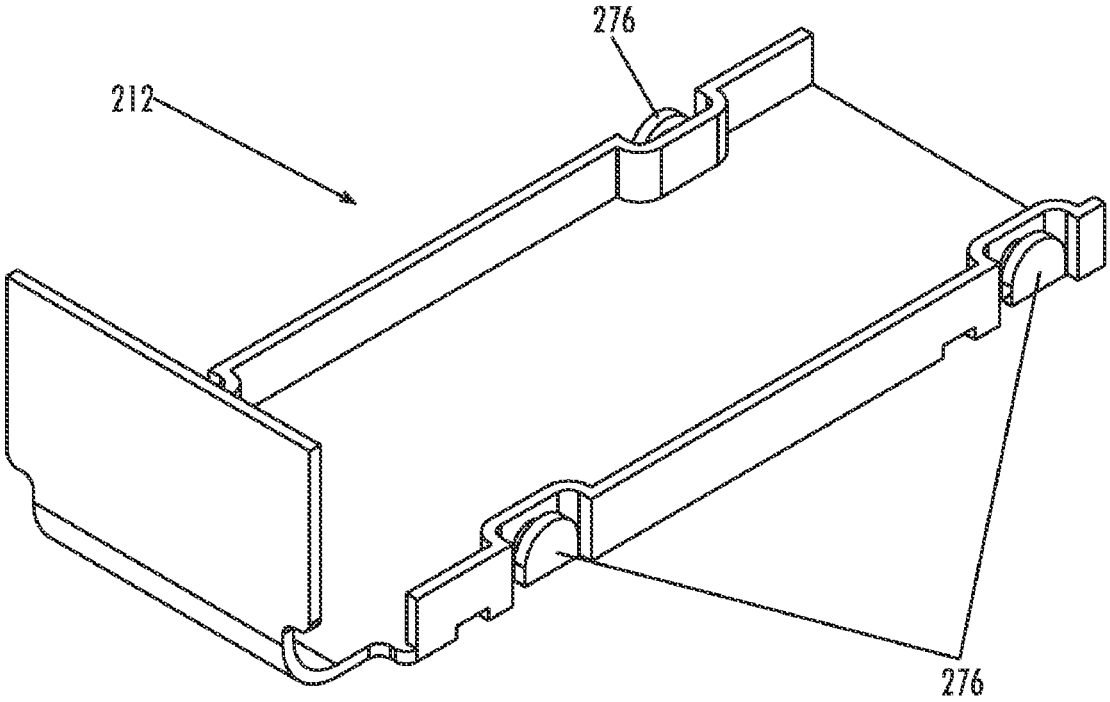
FIG. 44 is a perspective view of the cover of FIG. 24.
Figure 45:
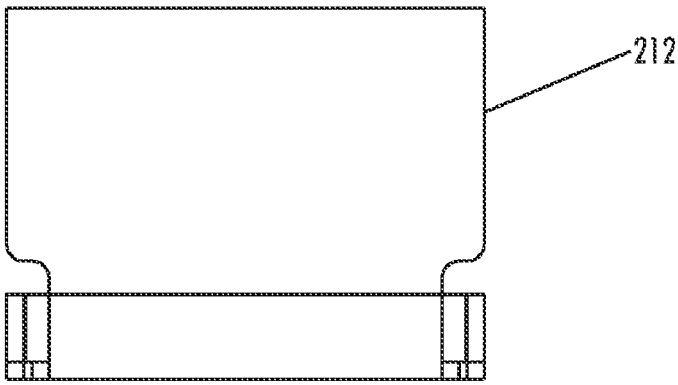
FIG. 45 is a front plan view of the cover of FIG. 44.
Figure 46:
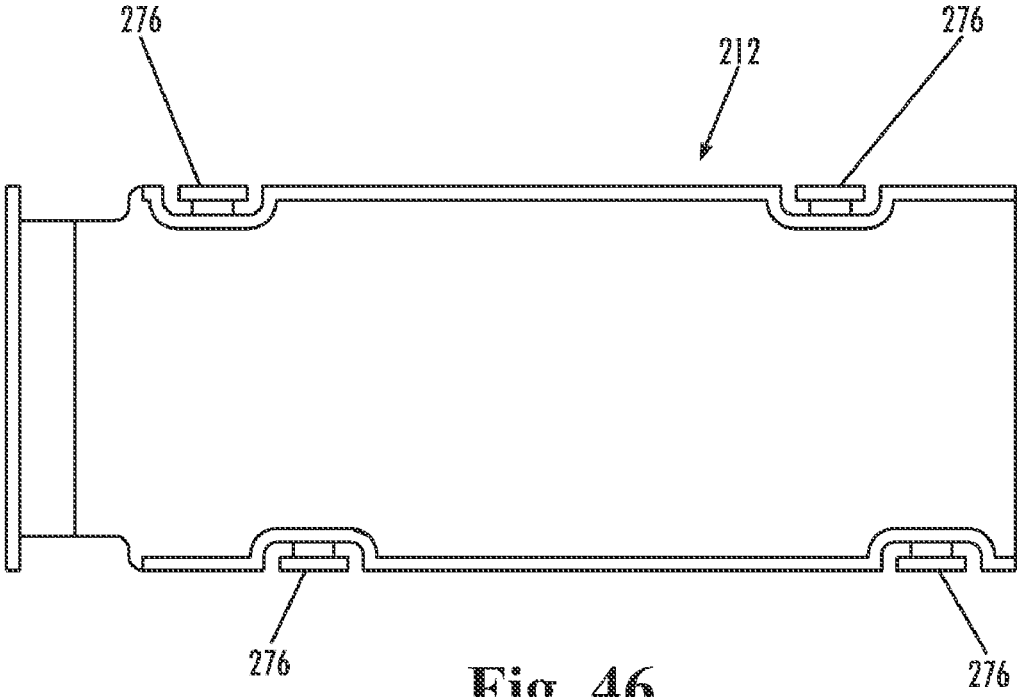
FIG. 46 is a bottom plan view of the cover of FIG. 44
Figure 47:
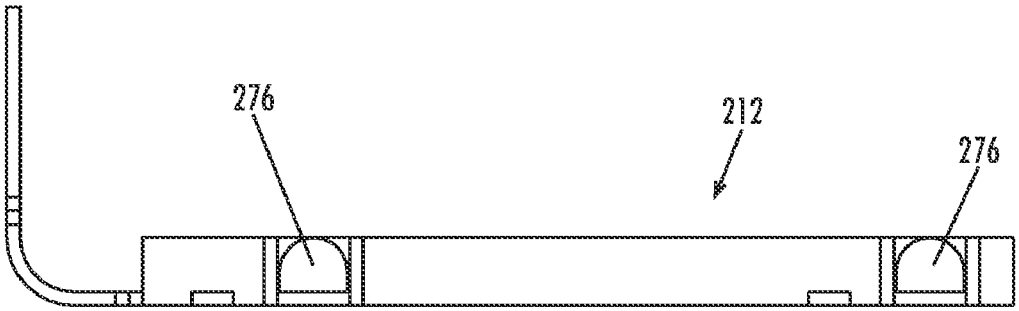
FIG. 47 is a side plan view of the cover of FIG. 44.

In some embodiments, access to the product stored on track 216 is blocked by a cover 212, shown in FIGS. 44-47. As shown in FIG. 44, cover 212 may include projections 276 that are configured to be captured by securing extensions 274 of the divider 204 to secure cover 212 to the top of pushing assembly 200. Cover 212 prevents a user from reaching into the top of the pushing assembly 200 and removing product stored on the track 216. Use of cover 212 is particularly desirable when access to the top of the pushing assembly 200 is not otherwise restricted, such as by use of a top shelf unit 202 as shown in FIG. 24. For example, use of the cover 212 prevents access to product stored on the track 216 when the pushing assembly 200 is placed on a countertop or free standing shelf.

Figure 48:
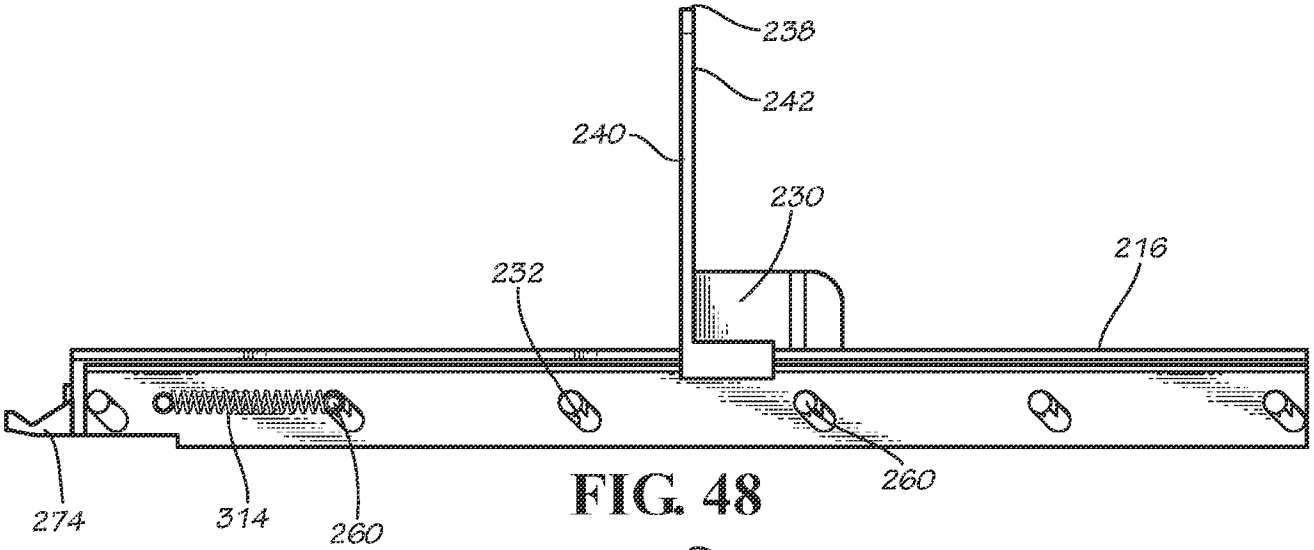
FIG. 48 is a side view of a pushing assembly according an alternate embodiment, when the stop is in the disengaged position.
Figure 49:
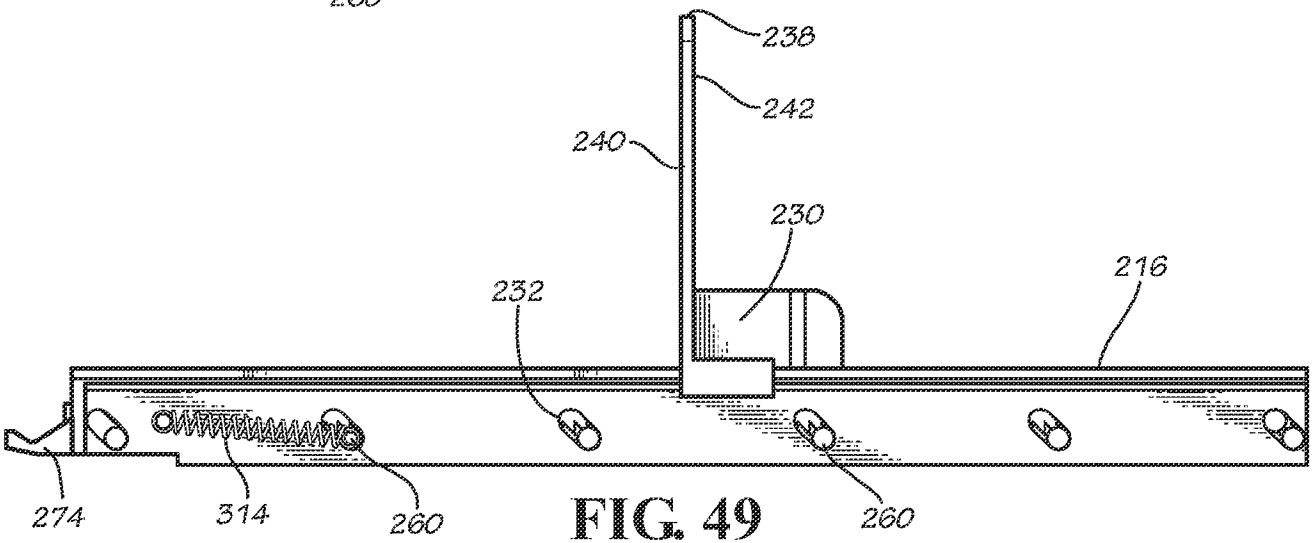
FIG. 49 is a side view of the pushing assembly of FIG. 23, when the stop is in the engaged position.
Figure 50:
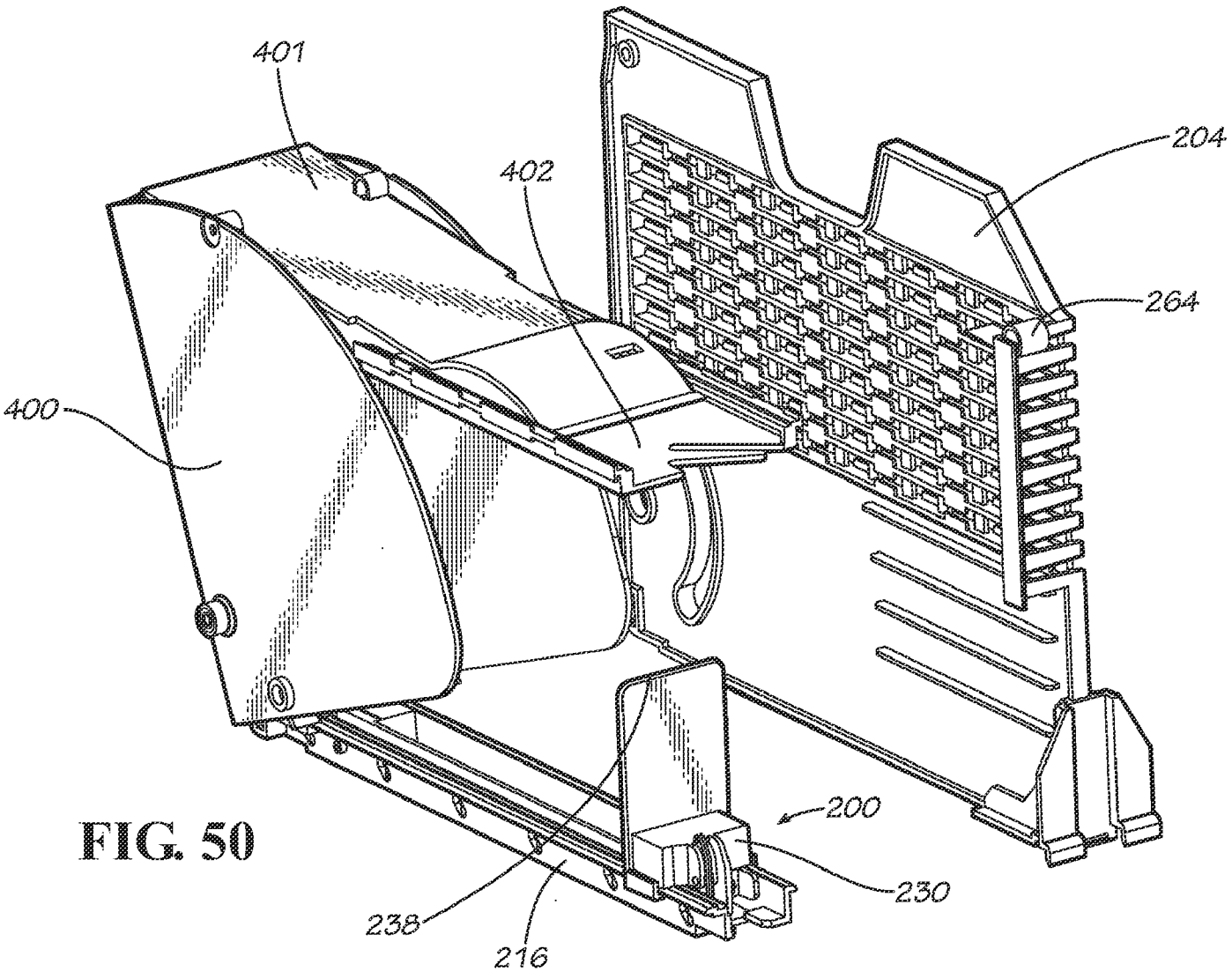
FIG. 50 is a perspective view of a tip bin door assembly, shown positioned with respect to a divider and a pushing assembly, according to one embodiment of the present invention.
Figure 55:
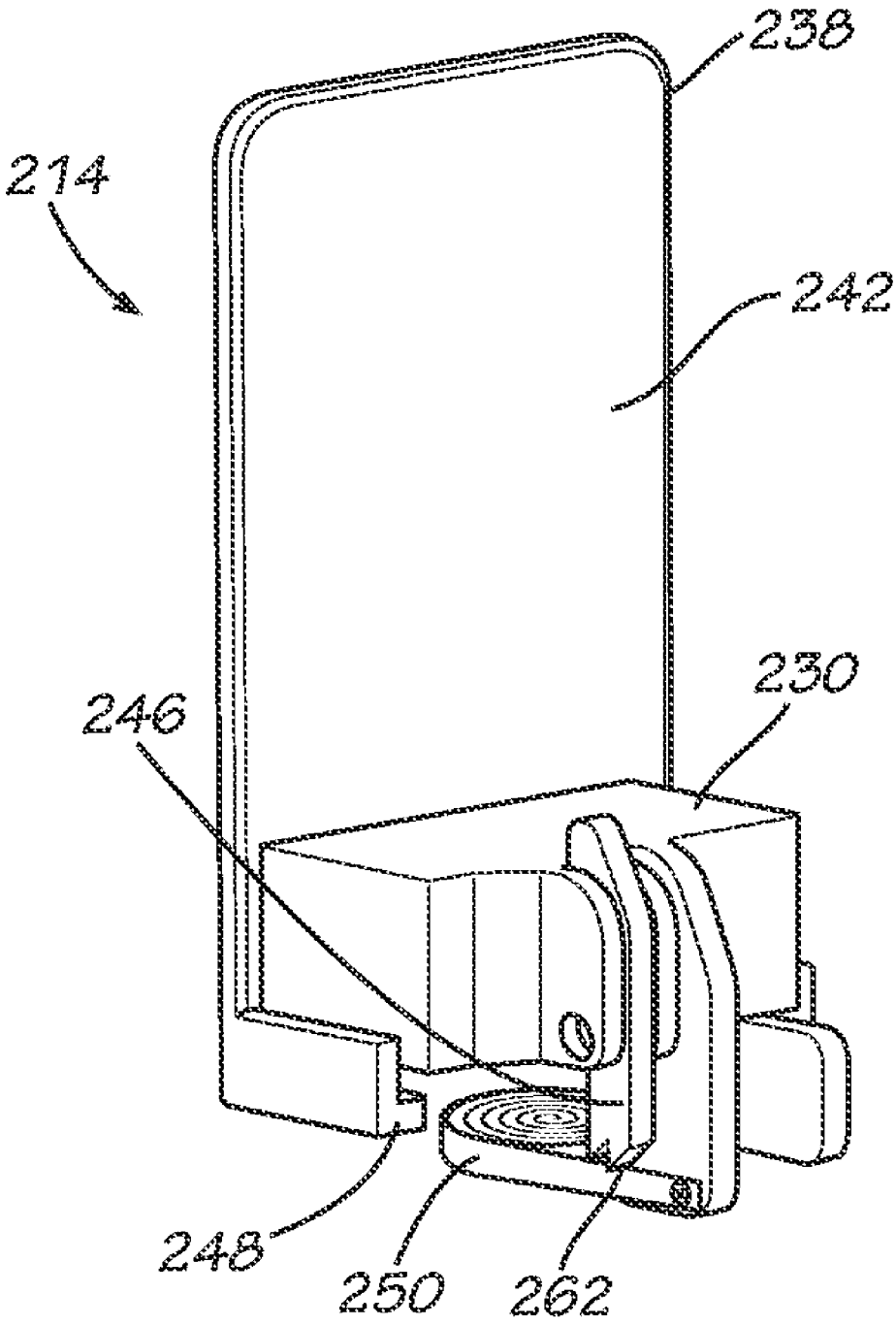
FIG. 55 is a rear perspective view of a pusher according to another embodiment of the present invention.

FIGS. 48-50 show an alternate embodiment of pushing assembly 200. The pushing assembly of FIGS. 48-50 includes a stop 254 that prevents pusher 214 from advancing product forward when the stop is in a disengaged position. When the stop 254 is in the disengaged position, the engagement surfaces 256 of the stop 254 (shown in FIG. 40) engage the projections 262 of the brake 246 (shown in FIG. 55) that extend into resistance channel 234. When projections 262 of the brake 246 engage the engagement surfaces 256 of the stop 254, stop 254 prevents forward movement of the pusher 214.

Specifically, when engaged, stop 254 allows the pusher 214 to move in a forward direction and thus advance product forward. In some embodiments, when stop 254 is engaged, the pusher 214 can move in increments of a predetermined amount, such increments corresponding to the depth of the product. As explained above, stop 254 includes engagement surfaces 256 that form generally a sawtooth shape in cross section. Stop 254 is positioned within resistance channel 234 so that protrusions 260 of stop 254 are received in ramped slots 232 on the side of the track 216 (shown in FIGS. 48-49). When stop 254 is in a disengaged position, shown in FIG. 48, protrusions 260 of the stop are located at one end of the slots 232. When sufficient force is applied to the front face 258 of the stop 254, the protrusions 260 on the side of the stop 254 move from one end of slots 232 to the other end of slots 232. Because slots 232 are sloped along track 216, the application of the force to the front face 258 of stop 254 moves protrusions 260 downward in slots 232, as shown in FIG. 49. In this way, when horizontal force is applied to the front face 258 of stop 254, stop 254 moves both horizontally toward the rear of the track 216 and downward at the same time. When stop 254 is thus lowered to the engaged position (FIG. 49), the engagement surfaces 256 of the stop 254 are lower so that they no longer engage with the projections 262 of the brake 246 that extend into resistance channel 234. When projections 262 of the brake 246 thus disengage the engagement surfaces 256 of the stop 254, stop 254 no longer prevents forward movement of the pusher 214. Spring 314 (shown in FIGS. 48-49) may be used to slow the speed at which stop 254 returns to its disengaged position; this speed can be adjusted to correspond to the amount of time needed for the pusher 214 to move a predetermined increment, such increment corresponding, for example, to the depth of one product.

This alternate embodiment of pushing assembly 200 also may be assembled with a door assembly 218 that is configured to cooperate with stop 254 so that when the door assembly 218 is closed, the door assembly 218 applies sufficient force to engage the stop 254 into its engaged position to allow forward movement of the pusher 214.

Figure 51:
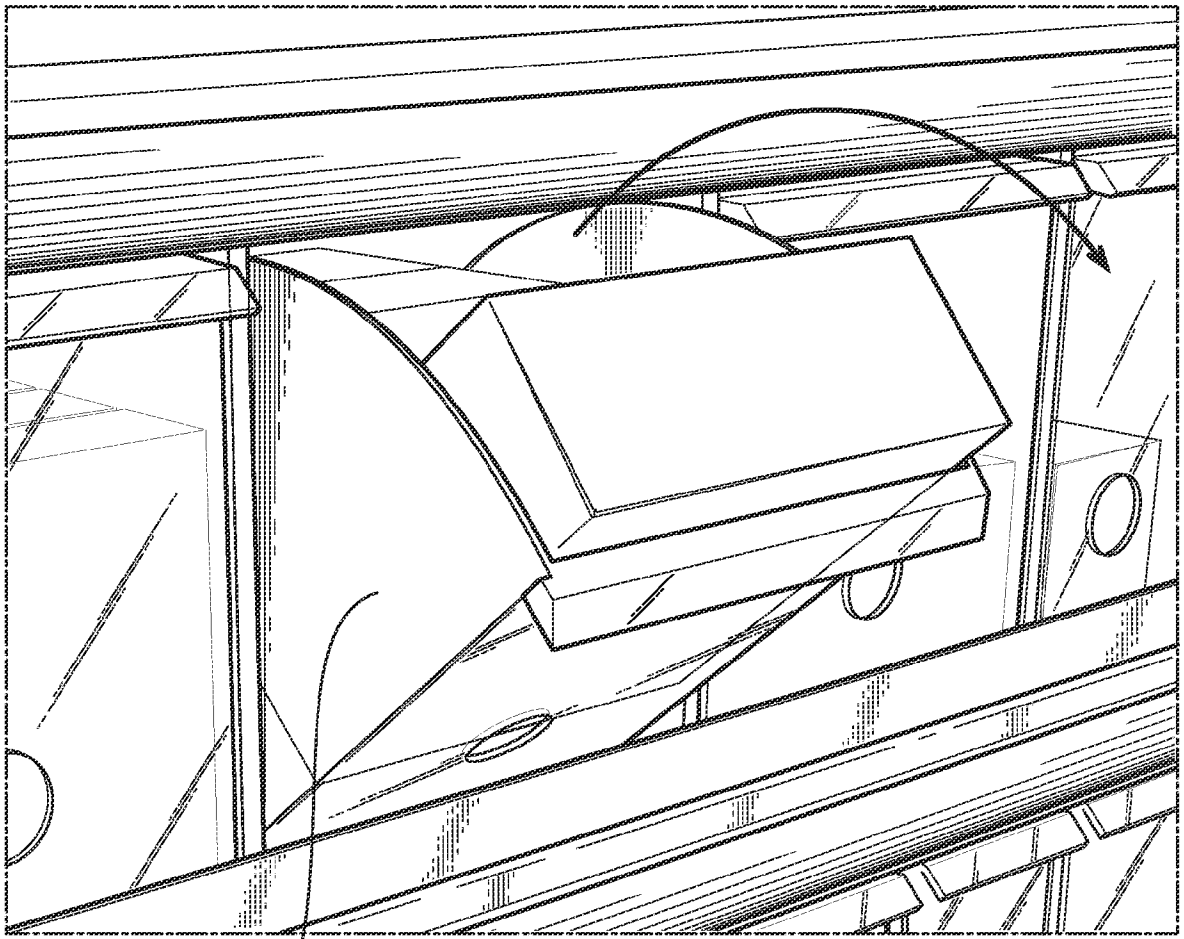
FIG. 51 is another perspective view of a tin bin door assembly, as assembled between shelving units and being opened for vending, according to one embodiment of the present invention.

In certain embodiments, as shown in FIGS. 50-51, door assembly 218 is a tip bin style door 400 that pivots open to provide a consumer with access to the product. When tip bin door 400 is in a closed position, access to product located behind the door is blocked to a consumer. In some embodiments, when tip bin door 400 pivots forward, tip bin door 400 allows access to the forward-most product on the pushing assembly 200, but includes a cover comprised of pivoting roof 401 and sliding roof 402 (FIG. 50) that both pivots and slides to prevent access to remaining product housed in the pushing assembly 200.

Figure 52:
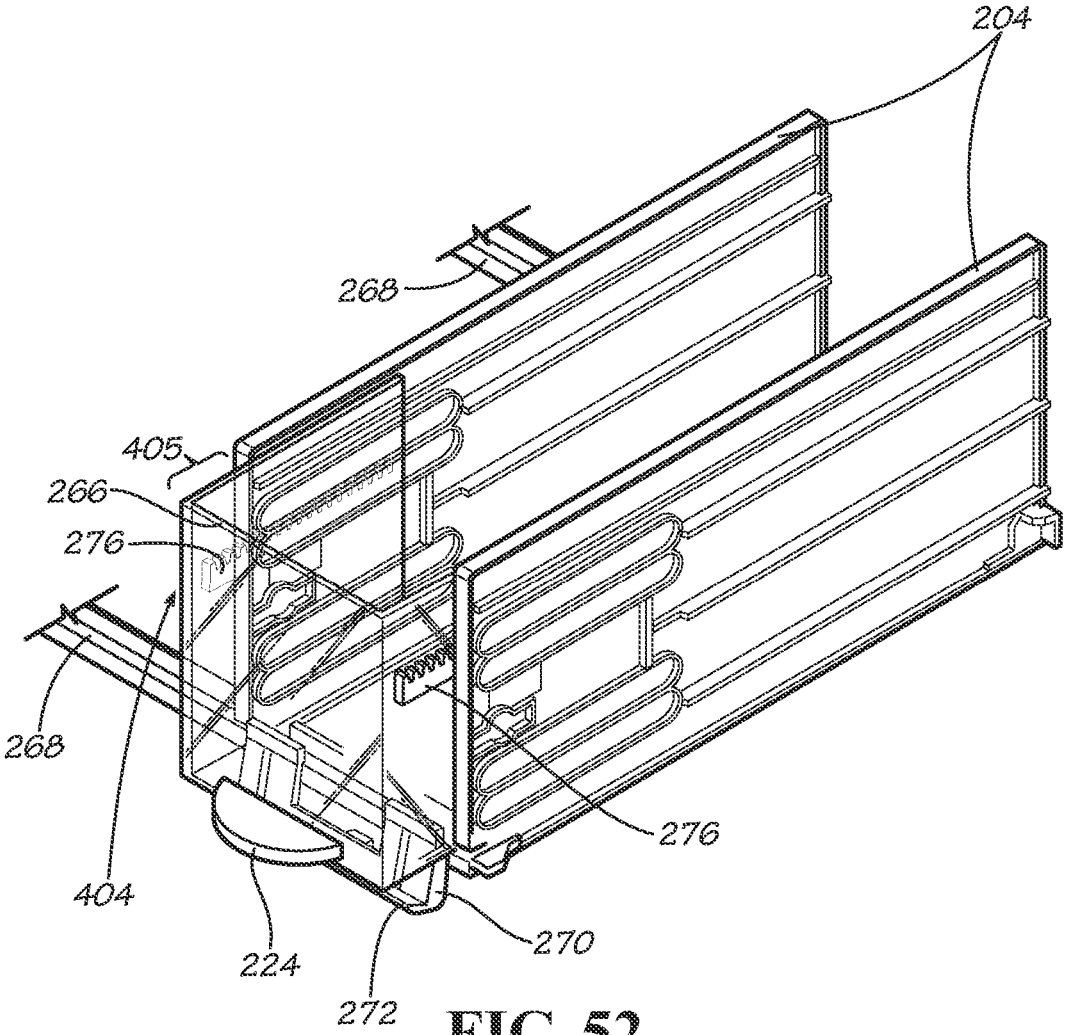
FIG. 52 is a perspective view of a shuttle style door assembly according to one embodiment of the present invention, when the shuttle style door assembly is in the open position.
Figure 53:
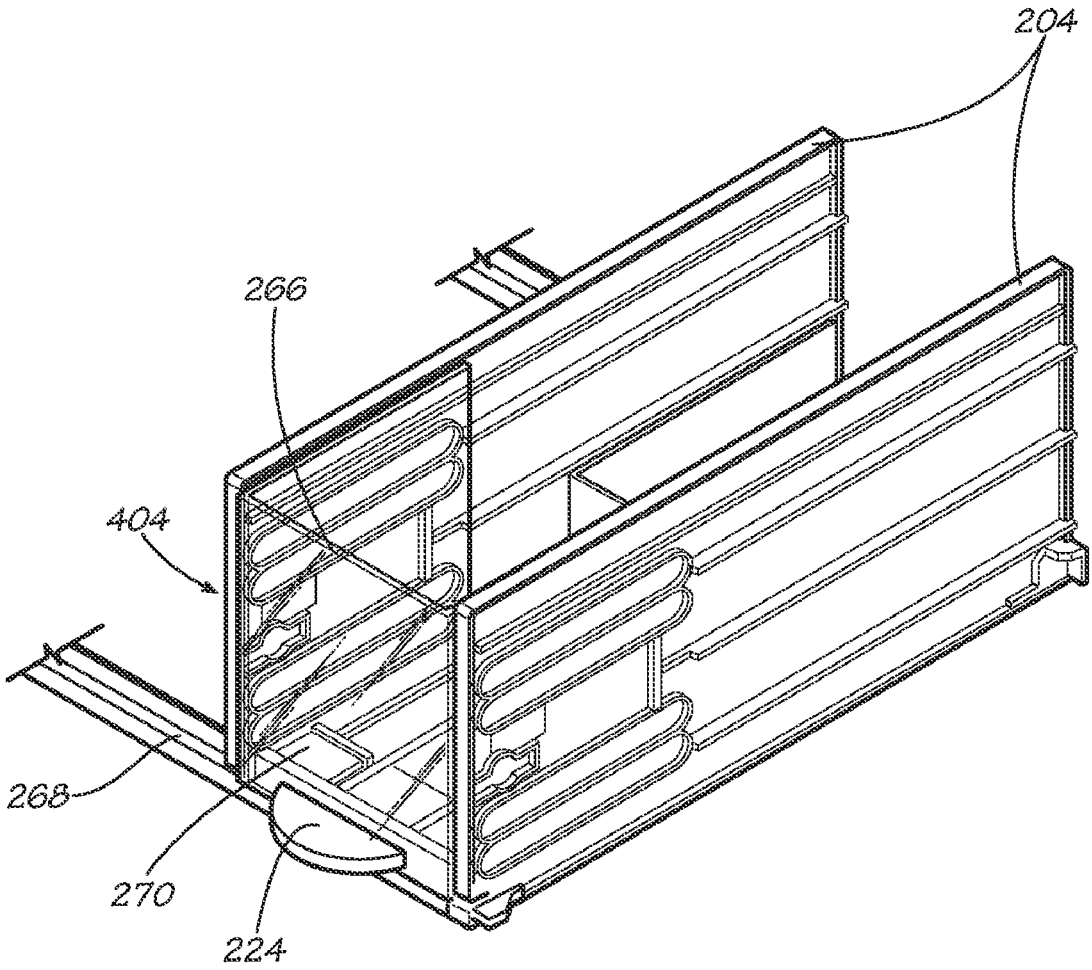
FIG. 53 is a perspective view of the shuttle door assembly of FIG. 11, when in the closed position.
Figure 54:
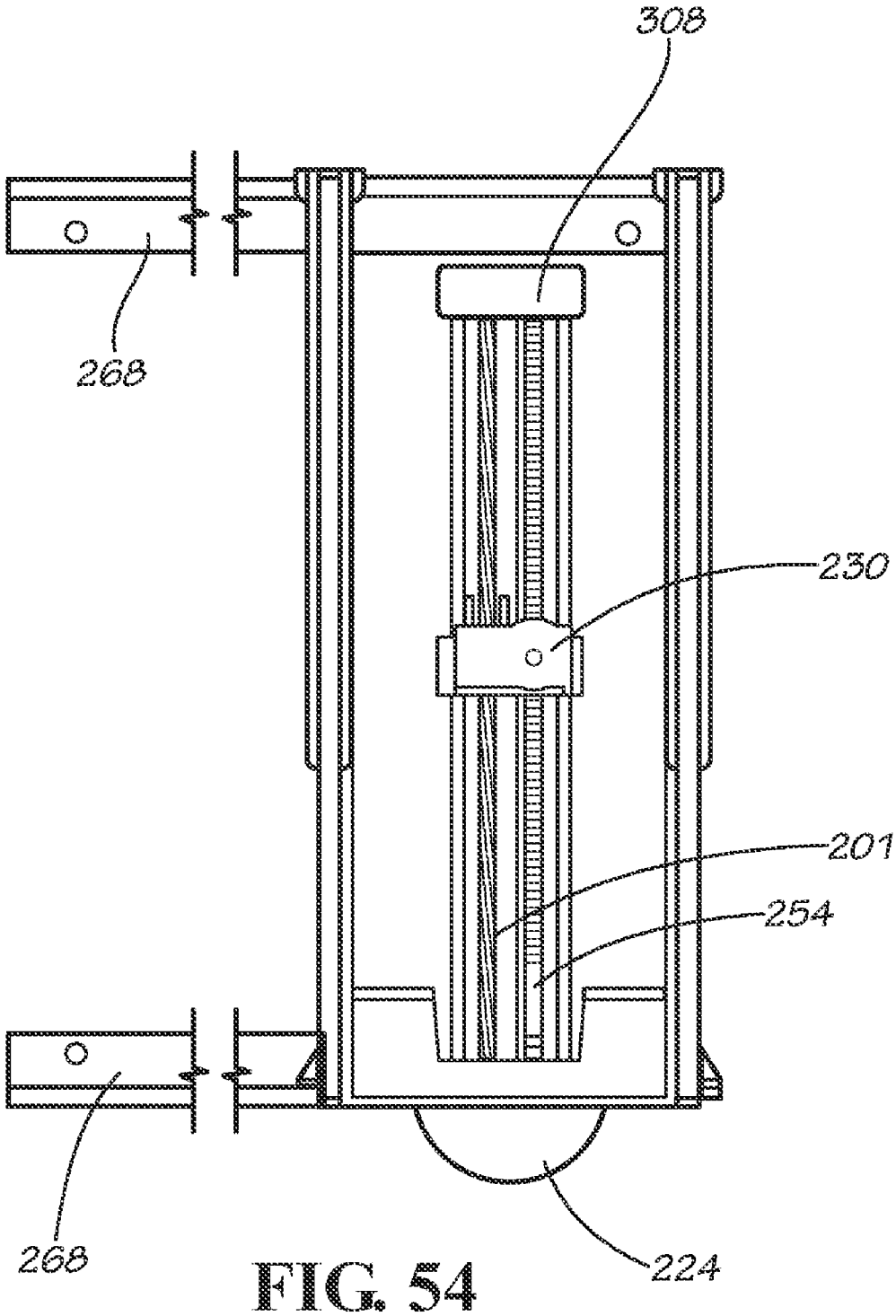
FIG. 54 is a top view of the shuttle door assembly of FIG. 11, as assembled with a pushing system.

In other embodiments, as shown in FIGS. 52-53, door assembly 218 is a shuttle door 404 that includes a shuttle 270. When shuttle door 404 is in a closed position (FIG. 53), access to product located behind the front face 266 of shuttle door 404 is blocked to a user. When shuttle door 404 is in the closed position, as shown in FIG. 53, the shuttle 270 is in a substantially horizontal orientation. The shuttle 270 is positioned relative to the pushing assembly 200 so that product located in the forward-most position relative to the pushing assembly 200 rests on the shuttle 270 when the shuttle door 404 is in the closed position, as shown in the figures. Shuttle 270 also includes a lip 272 (shown in FIG. 52).

Shuttle door 404 further may include a ledge 224, which is accessible to a user. When a user pulls ledge 224 to open shuttle door 404, a front face 266 of shuttle door 404 slides outward toward the user and the shuttle 270 pivots so that it drops from a substantially horizontal position to a substantially vertical position, as shown in FIG. 52. In this way, any product that was resting on the shuttle when the shuttle door 404 was closed drops down to rest on the lip 272 of the shuttle 270. Because the front face 266 has moved toward the front of the assembly, a user is able to access the vended product through the opening 405 in the shuttle door 404 (FIG. 52).

The shuttle 270 is positioned relative to the stop 254 so that, in certain embodiments, when the shuttle 270 is in the substantially horizontal position (shuttle door 404 is closed as shown in FIG. 53), stop 254 is engaged and the pusher 214 is free to move forward due to the action of the spring 250 and, in some embodiments, as slowed by the resistance mechanism, until a product reaches the forward-most position and abuts the front face 266 of shuttle door 404. Once the forward-most product abuts the front face 266 of shuttle door 404, additional product is restricted from advancing forward and the pusher 214 comes to a stop. When shuttle 270 drops to its substantially vertical position (shuttle door 404 is open as shown in FIG. 52), the product that was resting on the floor of shuttle 270 drops so that it is accessible to the user, while shuttle 270 also disengages stop 254, which prevents the pusher 214 from moving forward and advancing additional product for vending.

Figure 58:
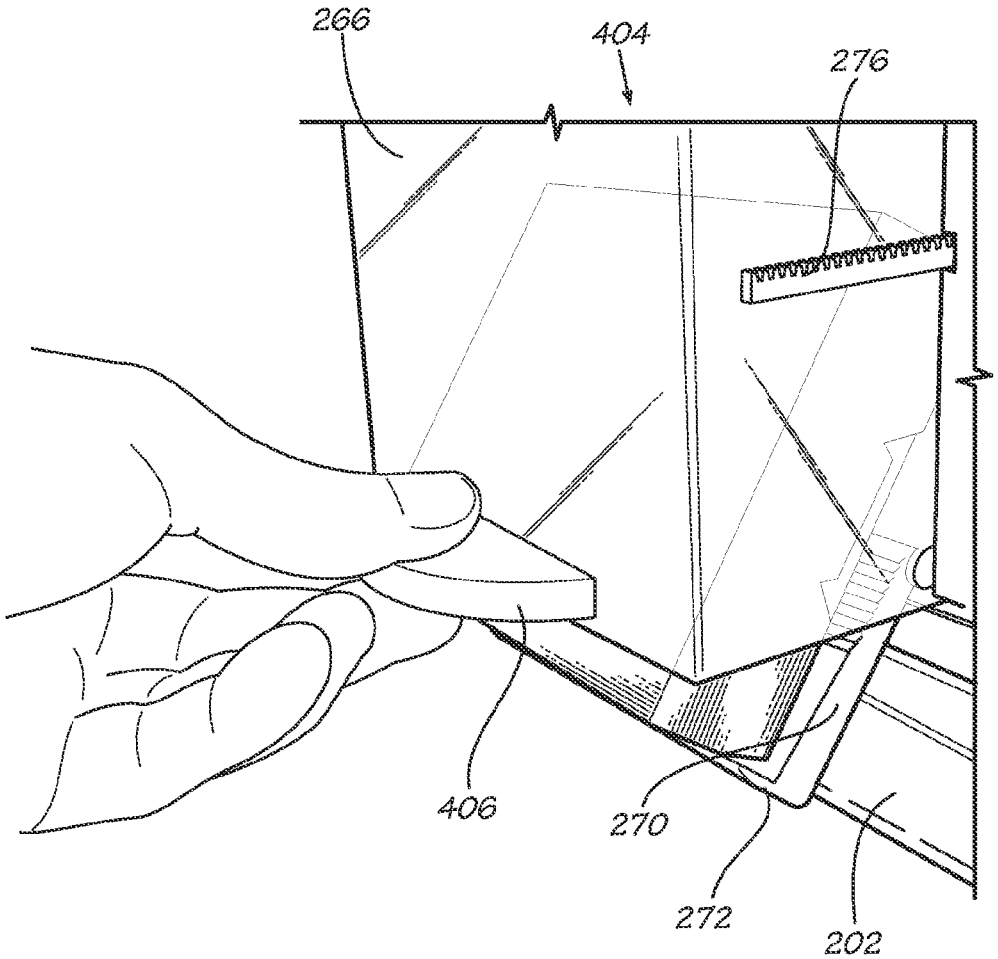
FIG. 58 is a perspective view of a shuttle style door assembly according to one embodiment of the present invention, as the shuttle style door assembly is being opened.

In this way, when the shuttle door 404 is closed, the shuttle 270 applies a generally horizontal force to stop 254 so that the stop 254 moves downward and forward along slots 232 into its engaged position (FIG. 58). Once in the engaged position, the engagement surfaces 256 of stop 254 no longer engage the protrusions 262 of brake 246 and pusher 214 is free to move forward due to the action of the spring 250, as described above, so long as there is room between the front face 266 of shuttle door 404 and the next product to be vended.

When the shuttle door 404 (or other suitable door assembly) is open, the shuttle 270 (or other suitable structure) disengages stop 254 so that engagement surfaces 256 of stop 254 engage the protrusions of brake 246 and prevent pusher 214 from moving forward. In this way, the pushing assembly 200 is configured so that only one product may be removed at a time. The pushing assembly 200 is also configured so that product may only be removed when it is against the front face 266 of shuttle door 404 and received on the shuttle 270. This requires someone who wants to remove more than one product from the pushing system to wait for several seconds between removal of each product, which has been found to be a substantial deterrence to product theft. Moreover, door assembly 218 (such as shuttle door 404 or tip bin door 400) may include a spring or other mechanism (such as spring 264 in FIG. 50) that urges the door assembly 218 to its closed position.

In certain embodiments, a spacer 274 (shown in FIGS. 48-49) may be used to accommodate products of different depths. Thus, use of a spacer 274 allows the door assembly 218 to accommodate a product that is greater in its depth dimension than the depth of the door assembly 218 without the spacer. Specifically, the depth of the spacer 274 corresponds to the depth of the product in relation to the depth of the door assembly 218. Similarly, the front to back ratio of the pushing assembly 200 also relates to the depth of the product. In this way, the pushing assembly 200 and door assembly 218 are customizable to accommodate products of varying dimensions and to meet the needs of a retail store. The tallest product that may be used with the door assembly 218 dictates the design of the door.

As shown in FIGS. 24 and 56-58, in some embodiments, pushing assembly 200 is placed between two gondola-type retail shelves 202. In some embodiments, a plurality of pushing assemblies 200 are placed on the shelf 202 and separated by dividers 204. In some embodiments, the door assembly 218 is connected to the dividers 204. The dividers 204 and pushing assemblies 200 are then connected to a rail 268, shown in FIGS. 52-54 and 56-57, that is in turn attached to the shelf 202. The height of the pushing assemblies 200 and dividers 204 may be adjusted to accommodate the distance between the shelves 202. The dividers 204 and/or shuttle door 404 may optionally include a bar 276 (shown in FIGS. 52 and 58) that is either after-affixed or integrally molded as part of the dividers 204. The bar 276 may include rack gear teeth capable of engaging a damper associated with the door assembly 218 so that the door eases shut instead of slamming shut.

Figure 56:
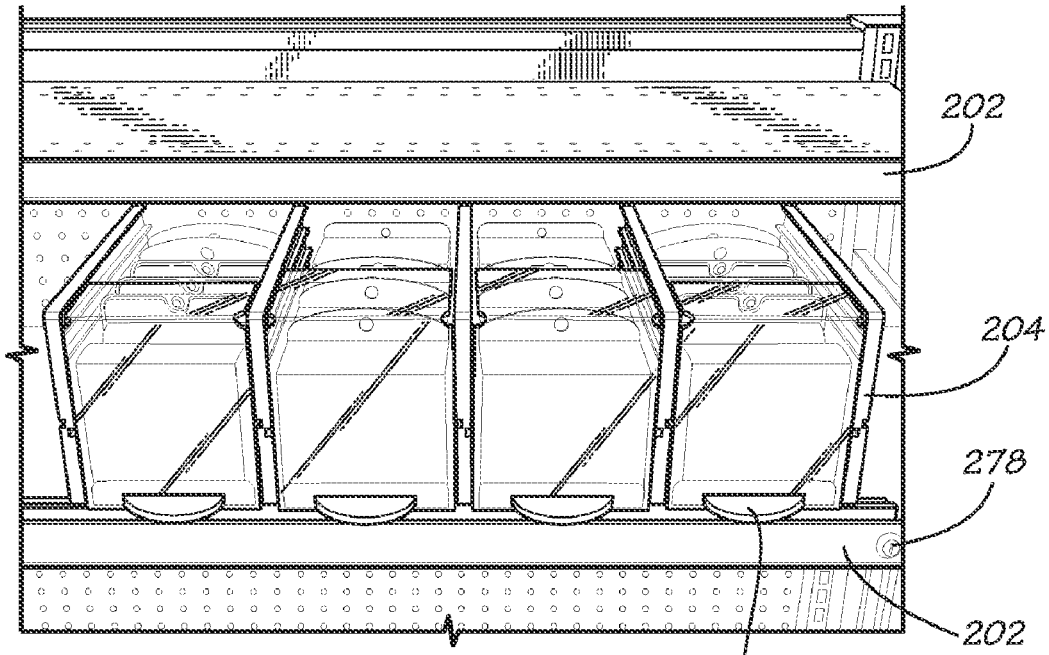
FIG. 56 is front view of a shelving unit that contains a plurality of pushing assemblies according to yet another embodiment of the present invention, with the shelving unit pulled out in drawer-like fashion.
Figure 57:
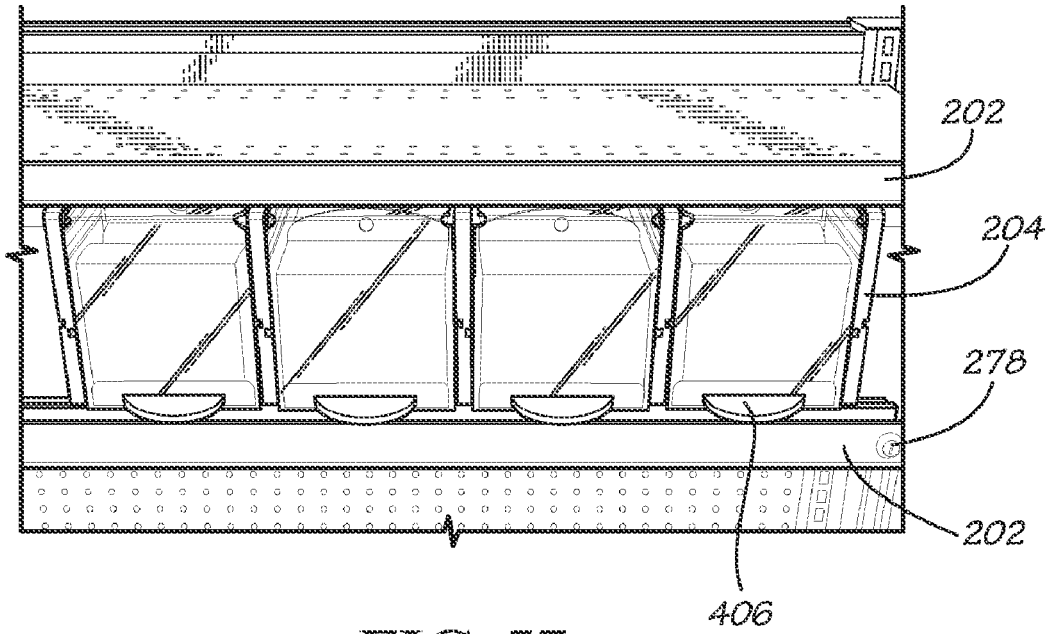
FIG. 57 is a perspective view of the shelving unit of FIG. 56, with the shelving unit in position for vending.

In some embodiments, shown in FIGS. 56-57, shelf 202 can be a sliding shelf. In these embodiments, shelf 202 may include a lock 278 that locks the shelf 202 in place. When unlocked, as shown in FIG. 56, the shelf 202 is capable of sliding forward in a drawer-like fashion so that product can be easily re-stocked from above.

While the invention has been described in detail with particular reference to the disclosed embodiments, it will be understood that variations and modifications can be affected within the spirit and scope of the invention as described herein.

The invention claimed is:

1. A pushing system comprising:

(a) a track comprising:
  (i) a product display surface; and
  (ii) a resistance channel comprising gear teeth that project into the resistance channel; and
  (iii) sides comprising a plurality of ramped slots;

(b) a pusher in sliding engagement with the track, the pusher comprising a brake;

(c) a spring that urges the pusher toward the front of the track;

(d) a stop positioned relative to the pusher and moveable between a disengaged position and an engaged position, the stop comprising:
  (i) a plurality of protrusions configured to cooperate with the plurality of ramped slots of the side of the track and;
  (ii) a plurality of engagement surfaces configured to engage the brake of the pusher to prevent the pusher from moving forward when the stop is in the engaged position;

(e) a resistance mechanism that comprises an external gear component that cooperates with the gear teeth of the resistance channel to slow the speed at which the spring urges the pusher forward; and (f) a second spring configured to adjust the orientation of the brake relative to the plurality of engagement surfaces of the stop when the stop is in the engaged position so that the pusher is not prevented from moving backward along the track.

2. The pushing system of claim 1, wherein, when the stop is in the engaged position, the plurality of protrusions of the stop are positioned relative to a first end of the plurality of the slots of the track, and wherein, when the stop is in the disengaged position, the plurality of protrusions are positioned relative to a second end of the plurality of the slots.

3. The pushing system of claim 1, wherein the brake further comprises a projection that cooperates with the engagement surfaces of the stop when the stop is in the engaged position.

4. The pushing system of claim 1, wherein the engagement surfaces of the stop form a generally sawtooth shape in cross section.

5. The pushing system of claim 1, wherein the stop is positioned within the resistance channel of the track.

6. The pushing system of claim 1, further comprising a door assembly positioned relative to the stop and having a closed position and an open position, wherein when in the open position, the door assembly engages the stop into the engaged position.

7. The pushing system of claim 1, wherein the system is configured so that when the stop is in the engaged position, the pusher is only permitted to move in predetermined increments.

8. The pushing system of claim 6, wherein the door assembly is a pivotable door having a closed position and an open position.

9. The pushing system of claim 8, wherein when the door assembly is in the open position, the stop is in the engaged position.

10. The pushing system of claim 8, wherein the door assembly further comprises an extension that rotates when the door assembly is in the open position to engage the stop into the engaged position.

11. The pushing system of claim 1, further comprising a cover configured to block access to the product display surface.

12. The pushing system of claim 1, further comprising a shaft that cooperates with a potentiometer.

13. A pushing system comprising:

(a) a track comprising:

(i) a product display surface; and (ii) a resistance channel comprising gear teeth that project into the resistance channel; and (iii) sides comprising a plurality of ramped slots;

(b) a pusher in sliding engagement with the track, the pusher comprising a Brake;

(c) a spring that urges the pusher toward the front of the track;

(d) a stop positioned relative to the pusher and moveable between a disengaged position and an engaged position, the stop comprising:

(i) a plurality of protrusions configured to cooperate with the plurality of ramped slots of the side of the track and;

(ii) a plurality of engagement surfaces configured to engage the brake of the pusher to prevent the pusher from moving forward when the stop is in the engaged position;

(e) a resistance mechanism that comprises an external gear component that cooperates with the gear teeth of the resistance channel to slow the speed at which the spring urges the pusher forward; and (f) a door assembly positioned relative to the stop and having a closed position and an open position, wherein when in the open position, the door assembly engages the stop into the engaged position, wherein the door assembly comprises a shuttle having a first position and a second position, wherein when the shuttle is in a first position, the shuttle is generally horizontal and the stop is in the disengaged position, and wherein when the shuttle is in a second position, the shuttle is generally vertical and the stop is in the engaged position.

14. A device for controlled advancement of a product comprising:

(a) a track comprising:

(i) a product display surface; and (ii) an index channel comprising a plurality of inclines; and (b) a pusher in sliding engagement with the track;

(c) a spring that urges the pusher toward the front of the track; and (d) an indexing system having an activated state, wherein when the indexing system is in the activated state, the pusher may only move forward a discrete distance, wherein the indexing system comprises:

(i) a rod;

(ii) an indexing member coupled to the pusher, the indexing member comprising a body, a lateral arm positioned relative to the rod, and a downward extension; and (iii) an index having a plurality of openings, wherein each of the plurality of openings is configured to receive the downward extension of the body of the indexing member, wherein a distance between the plurality of openings generally corresponds to a depth of the product to be advanced.

15. The device of claim 14, further comprising a resistance mechanism that slows the speed at which the spring urges the pusher forward.

* * * * *